US009277816B2

(12) United States Patent
Chen

(10) Patent No.: US 9,277,816 B2
(45) Date of Patent: Mar. 8, 2016

(54) SYNCHRONIZING DEVICE FOR A DRAWER SLIDE MECHANISM

(71) Applicant: SLIDE MEI YAO INTERNATIONAL CO., LTD., New Taipei (TW)

(72) Inventor: Tsung-Yao Chen, New Taipei (TW)

(73) Assignee: Slide Mei Yao International Co., Ltd., New Taipei (TW)

( * ) Notice: Subject to any disclaimer, the term of this patent is extended or adjusted under 35 U.S.C. 154(b) by 262 days.

(21) Appl. No.: 13/675,089

(22) Filed: Nov. 13, 2012

(65) Prior Publication Data

US 2013/0129266 A1 May 23, 2013

(30) Foreign Application Priority Data

Nov. 21, 2011 (TW) ..... 100142562 A

(51) Int. Cl.
*A47B 88/04* (2006.01)
*A47B 88/12* (2006.01)

(52) U.S. Cl.
CPC ..... *A47B 88/12* (2013.01); *A47B 88/04* (2013.01); *A47B 2210/0078* (2013.01); *Y10T 74/18808* (2015.01)

(58) Field of Classification Search
CPC ..... A47B 2210/0078; A47B 2210/0059; A47B 2210/0064; A47B 2210/007; A47B 2210/0083; F24C 15/168; F25D 25/022; F25D 25/025
USPC ..... 74/422, 409, 411.5, 412 R, 413; 312/331, 334.1, 334.7, 334.8
See application file for complete search history.

(56) References Cited

U.S. PATENT DOCUMENTS

| | | | | |
|---|---|---|---|---|
| 4,036,073 | A * | 7/1977 | Kitano | 74/393 |
| 4,351,383 | A * | 9/1982 | Gladwin | 164/448 |
| 7,594,707 | B2 * | 9/2009 | Kunkle | A47B 88/04 312/331 |
| 7,997,667 | B2 * | 8/2011 | Rotter | F25D 25/025 312/311 |
| 7,997,668 | B2 * | 8/2011 | Lee | 312/402 |
| 8,960,820 | B2 * | 2/2015 | Chen | 312/331 |
| 2006/0250059 | A1 * | 11/2006 | Lemm | A47B 88/047 312/331 |
| 2009/0261698 | A1 * | 10/2009 | Cabal Velarde et al. | A47B 88/044 312/334.8 |
| 2010/0236281 | A1 * | 9/2010 | Eom et al. | 62/449 |
| 2010/0283365 | A1 * | 11/2010 | Chen | 312/334.4 |
| 2011/0006656 | A1 * | 1/2011 | Nam et al. | 312/404 |
| 2011/0050065 | A1 * | 3/2011 | Lee | E05B 17/0033 312/402 |
| 2011/0187253 | A1 * | 8/2011 | Jaehrling et al. | 312/334.1 |
| 2011/0187254 | A1 * | 8/2011 | Chen et al. | 312/334.8 |
| 2013/0270987 | A1 * | 10/2013 | Kelly | 312/331 |

FOREIGN PATENT DOCUMENTS

| | | | |
|---|---|---|---|
| EP | 1036526 | A1 | 9/2000 |
| WO | 2007/007950 | A1 | 1/2007 |

* cited by examiner

*Primary Examiner* — William Kelleher
*Assistant Examiner* — Jude Agendia
(74) *Attorney, Agent, or Firm* — Rosenberg, Klein & Lee

(57) ABSTRACT

A synchronizing device includes a pair of longitudinal guiding units each having a rack member and a movement damper connected to the rack member, and a rotating mechanism including a pair of pinion gears to be meshed respectively with the guiding units. When the pinion gears move respectively from the rack members for rotation respectively on the movement dampers, an increased pressure is produced between the guiding units and the rotating mechanism, thereby slowing down and damping the rotation of the rotating mechanism.

14 Claims, 27 Drawing Sheets

SYNCHRONIZING DEVICE FOR A DRAWER SLIDE MECHANISM

CROSS-REFERENCE TO RELATED APPLICATION

This application claims priority of Taiwanese patent application no. 100142562, filed on Nov. 21, 2011.

BACKGROUND OF THE INVENTION

1. Field of the Invention

The invention relates to a synchronizing device, and more particularly to a synchronizing device for synchronizing a pair of drawer slide mechanisms.

2. Description of the Related Art

Generally, a pair of slide mechanisms with balls are respectively installed on two sides of a drawer or on a bottom of the drawer. Such slide mechanisms include a pair of inner rails respectively covered by and connected to outer rails for slidingly moving back and forth relative to each other.

Since gaps exist between the inner and outer rails of the slide mechanisms, when the inner rails move relative to the outer rails, the inner rails may be affected by an uneven force acting thereon and may not synchronously move in or out of a cabinet. Therefore, when being loaded, the drawer may wobble and may produce undesired rebound effect.

For improvement, as shown in FIGS. 26 and 27, a synchronizing device 9, as disclosed in Austrian Patent No. 006674U2, is provided for a pair of slide mechanisms 83 disposed between a caddy 81 and a drawer 82, so that the drawer 82 is able to move stably and smoothly back and forth relative to the caddy 81 (the figures illustrate only one of the slide mechanisms). Each of the slide mechanisms 83 has a longitudinal slide rail 831 disposed inside the caddy 81. The synchronizing device 9 includes two guiding racks 91 respectively disposed under the slide rails 831 (only one is shown as an example), two connecting devices 92 (only one is shown) disposed on the drawer 82, and a rotating mechanism 93 rotatably disposed between the two connecting devices 92 and movable along the two guiding racks 91. Since the synchronizing device 9 has symmetrical left and right parts, the figures illustrate only one symmetrical part of the synchronizing device 9 for the sake of brevity.

Each guiding rack 91 includes rack teeth 911 disposed on the corresponding slide rail 831, and a longitudinal ledge bar 912 extending parallel to the rack teeth 911 in proximity to the drawer 82. Each connecting device 92 includes a mounting plate 921 disposed on a rear side of the drawer 82, a bearing seat 922 disposed on the mounting plate 921 and movable upward and downward, and an abutting plate 923 extending from the bearing seat 922 and projecting toward the ledge bar 912 for abutting against a bottom of the ledge bar 912. The rotating mechanism 93 includes two shafts 931 respectively and rotatably disposed in the corresponding bearing seats 922, a tubular spindle 932 interconnecting and synchronizing the two shafts 931, and two pinion gears 933 respectively fixed to the shafts 931 and movably meshed with the rack teeth 911 of the guiding racks 91.

When the drawer 82 is pulled, the rotating mechanism 93 is driven for concomitantly moving along with the drawer 82. Each pinion gear 933 is meshed with and moves on the corresponding rack teeth 911. The abutting plate 923 is movable upward and downward together with the bearing seat 922, and supports a bottom of the ledge bar 912 to prevent the pinion gear 933 from disengaging from the rack teeth 911 when the drawer 82 swerves due to an external force. The pinion gear 933 is able to move on the guiding rack 91. If the slide mechanism 83 is obliquely assembled with respect to the guiding rack 91, the pinion gear 933 can still move on the rack teeth 911 without affecting the movement of the drawer 82 because of the use of a particular design of the bearing seat 922 for moving upward and downward relative to the mounting plate 921.

However, the conventional synchronizing device 9 is not able to decelerate the movement of the drawer 82 in either fully open or close states. Since the synchronizing device 9 does not have any damping structure for slowing down the speed of the drawer 82 relative to the caddy 1, such deficiency may result in collision of storage items in the drawer 82 during the final process of the fully open/close operation of the drawer 82. Besides, when the shaft 931 is forced to reduce speed and stop, abrasion wear and abrupt movement of the shaft 931 may occur, or undesirable continuous impact noise may be produced due to the rotation of the non-circular configuration of the shaft 931.

SUMMARY OF THE INVENTION

Therefore, the present invention is to provide a synchronizing device that can alleviate at least one drawback of the aforementioned conventional synchronizing device.

According to one aspect of the present invention, a synchronizing device is adapted for synchronizing sliding movements of a pair of drawer slide mechanisms, and includes a pair of longitudinal guiding units, and a rotating mechanism. Each of the guiding units has a rack member formed with a plurality of rack teeth, and a movement damper connected to and aligned longitudinally with the rack member. The rotating mechanism includes a pair of pinion shafts, a spindle that interconnects the pinion shafts to synchronize rotation of the pinion shafts, and a pair of pinion gears that are respectively connected to the pinion shafts and that are meshed respectively with the guiding units. Each pinion shaft has a journal section, and a spindle-connecting section connected to the spindle. The journal section has a tubular part, and a non-rigid outer cover surrounding the tubular part. The spindle-connecting section extends coaxially inside the tubular part. The tubular part and the spindle-connecting section cooperatively define an annular insert space. The rotating mechanism further includes a pair of movement-transmitting connectors. At least one of the movement-transmitting connectors has a shaft support body to journal a corresponding one of the pinion shafts, and a lubricant body disposed in the shaft support body to abut against the corresponding one of the pinion shafts. When the pinion gears move respectively from the rack members for rotation respectively on the movement dampers, the pinion gears are elevated so that an increased pressure is produced between the guiding units and the rotating mechanism, thereby increasing friction between the guiding units and the rotating mechanism, and slowing down and damping the rotation of the rotating mechanism.

According to another aspect of the present invention, a guiding unit of a synchronizing device is adapted to guide a rotating mechanism to rotate thereon, and includes a longitudinal rack member formed with a plurality of rack teeth, and at least one movement damper that is disposed at one end of the rack member for applying pressure to a pinion shaft of the rotating mechanism, which is able to slowdown a rotating speed of the pinion shaft.

According to a further aspect of the pre sent invention, a rotating mechanism of a synchronizing device, the synchronizing device being capable of eliminating continuous impact noise due to rotating movement, includes at least one pinion shaft, and a pinion gear that is integrally connected to the pinion shaft. The pinion shaft has a journal section that has a tubular part, and an outer cover surrounding the tubular part and made of a soft flexible material.

According to still another aspect of the present invention, a movement-transmitting connector of a synchronizing device, the synchronizing device being capable of eliminating abrasion, wear and abrupt movement through pressure application and speed reduction, is adapted for connection with a pinion shaft of a rotating mechanism of the synchronizing device, and includes at least one shaft support body for journaling the pinion shaft, and a lubricant body disposed in the shaft support body for abutting against the pinion shaft.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENT

Figure 1:
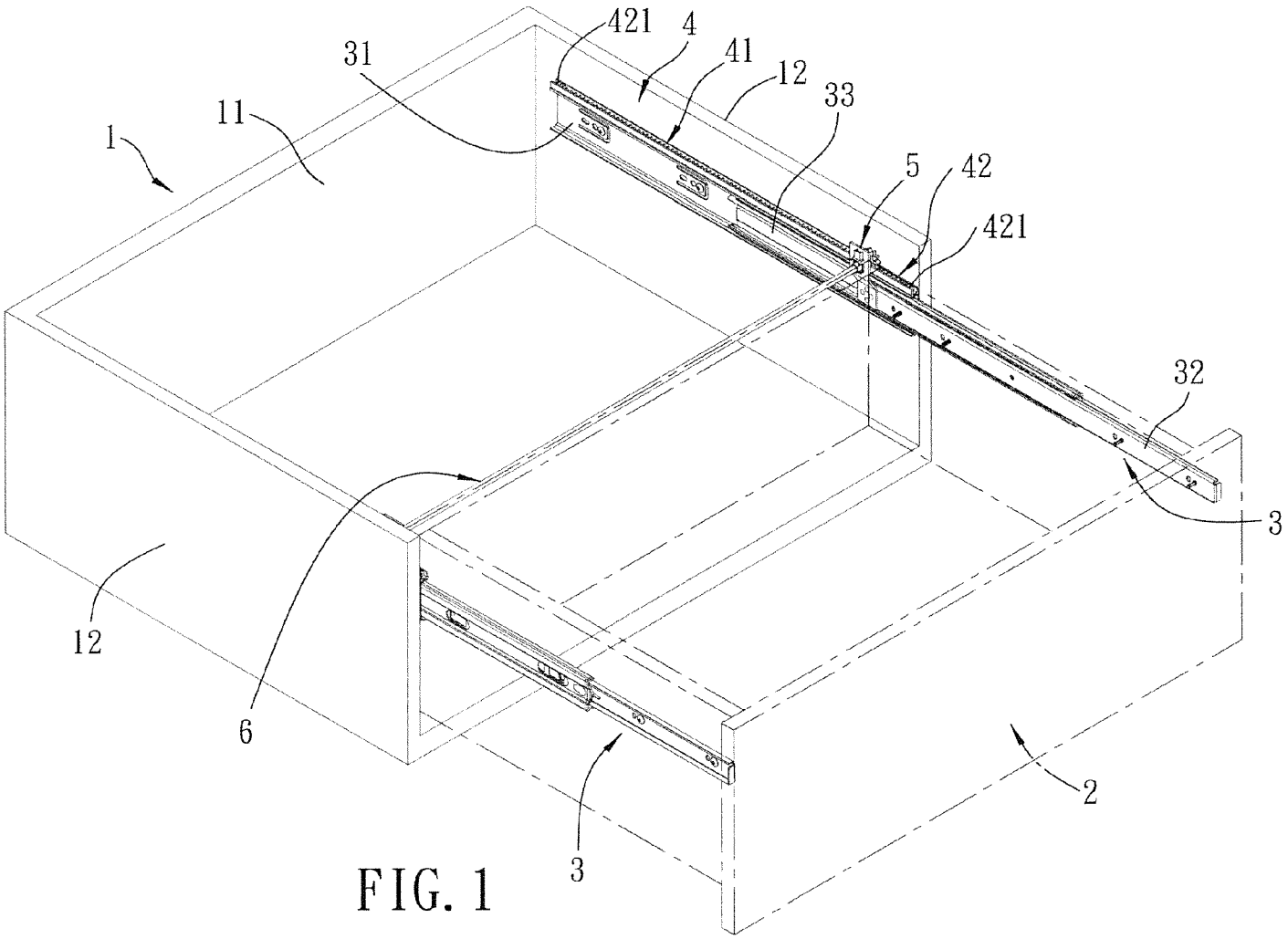
FIG. 1 is a perspective view illustrating a drawer, a drawer slide mechanism, and a first preferred embodiment of a synchronizing device according to the present invention.

Before the present invention is described in greater detail, it should be noted that like elements are denoted by the same reference numerals throughout the disclosure.

Referring to FIGS. 1 to 5, a caddy 1 incorporating a synchronizing device according to the first embodiment of the present invention is exemplified. The caddy 1 defines a space 11 within two side plates 12. A drawer 2 cooperates with a pair of drawer slide mechanisms 3 for sliding forward and backward relative to the caddy 1. The side plates 12 extend respectively at two opposite sides of the drawer 2 when the drawer 2 is received in the receiving space 11. Alternatively, the synchronizing device may be incorporated into a cabinet, an organizer, or the like.

Figure 4:
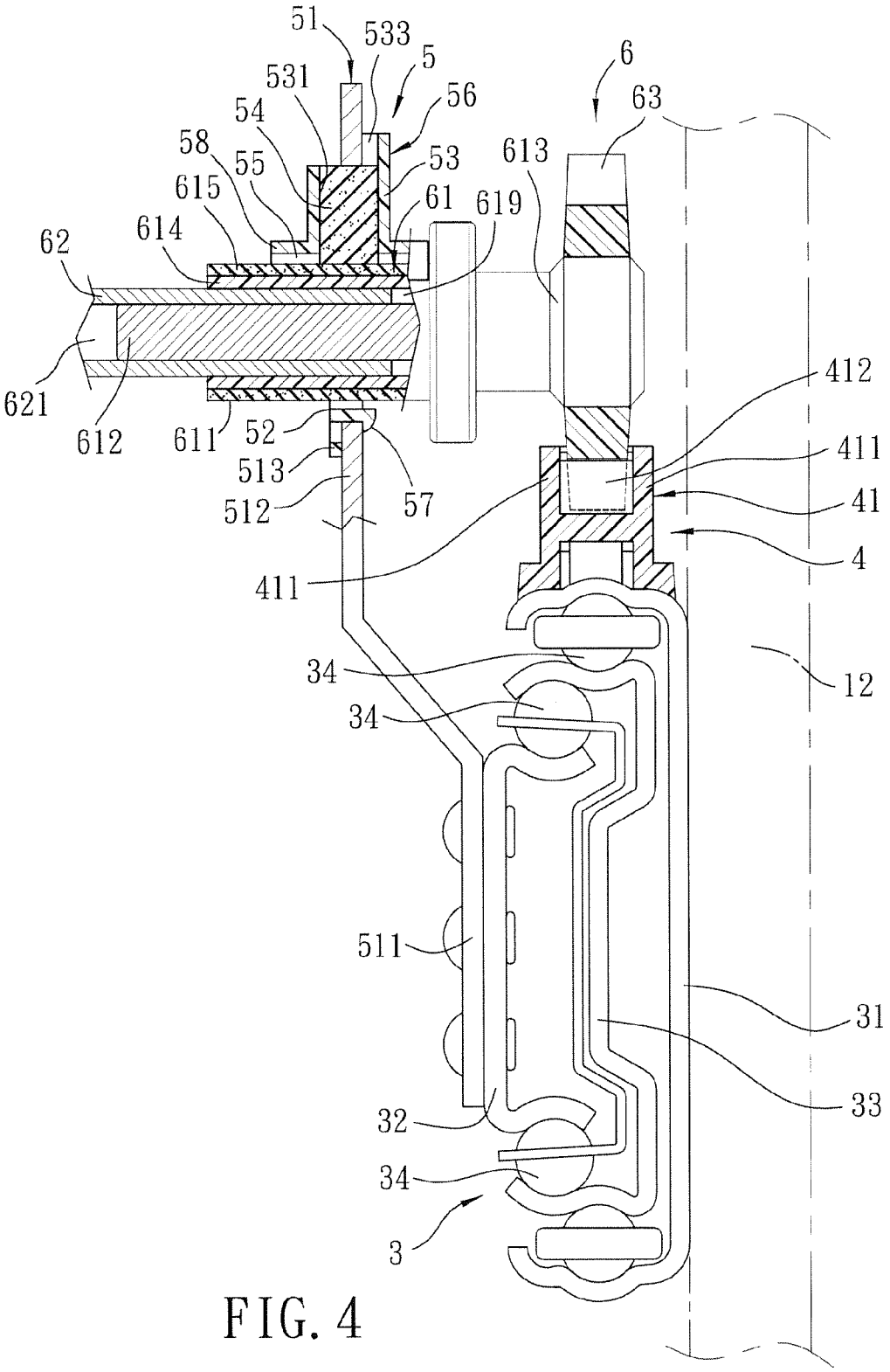
FIG. 4 is a fragmentary transverse sectional view of the first preferred embodiment, illustrating that a pinion gear is meshed with a rack member of a guiding unit.

The drawer slide mechanisms 3 are respectively disposed between the side plates 12 and the drawer 2. Each of the drawer slide mechanisms 3 has a first slide 31 disposed on one of the side plates 12, a second slide 32 disposed on one side of the drawer 2 and slidable relative to the first slide 31, and an intermediate slide 33 movably disposed between the first and second slides 31, 32 for lengthening a slide distance between the first and second slides 31, 32. Preferably, as shown in FIG. 4, each of the drawer slide mechanisms 3 further has a plurality of balls 34 that are disposed between the first slide 31 and the intermediate slide 33 and between the intermediate slide 33 and the second slide 32 for promoting slidability thereamong. However, the present invention should not be limited to the specific details described herein. In actual implementation, each drawer slide mechanism 3 may have only the first and second slides 31, 32. When the drawer 2 is pulled to move relative to the caddy 1, the second slides 32 slide relative to the first slides 31 for directing movement of the drawer 2. Since the drawer slide mechanisms 3 are well known to those skilled in the art, further details thereof are omitted herein for the sake of brevity.

The synchronizing device for synchronizing sliding movements of the drawer slide mechanisms 3 includes a pair of longitudinal guiding units 4 that are opposite to each other in a left-right direction, and a rotating mechanism 6. Only one guiding unit 4 on the right side and the rotating mechanism 6 are shown in the figures for the sake of brevity.

In this embodiment, the guiding units 4 are respectively mounted on top of the first slides 31 for respectively guiding the drawer slide mechanisms 3. Each of the guiding units 4 has a longitudinal rack member 41 formed with a plurality of rack teeth 412 spaced apart in a front-rear direction, and a movement damper 42 connected to and aligned longitudinally with the rack member 41 to damp rotation of the rotating mechanism 6 thereon.

In this embodiment, two movement dampers 42 are respectively connected to front and rear ends of the rack member 41. Each of the movement dampers 42 has a toothed portion 421, which is integrally connected to and longitudinally aligned with the rack member 41 at a corresponding of the front and rear ends of the rack member 41. Of course, the number of the toothed portions 421 may be reduced. For example, there may be only one toothed portion 421 integrally connected to one of front and rear ends of the rack member 41.

Figure 2:
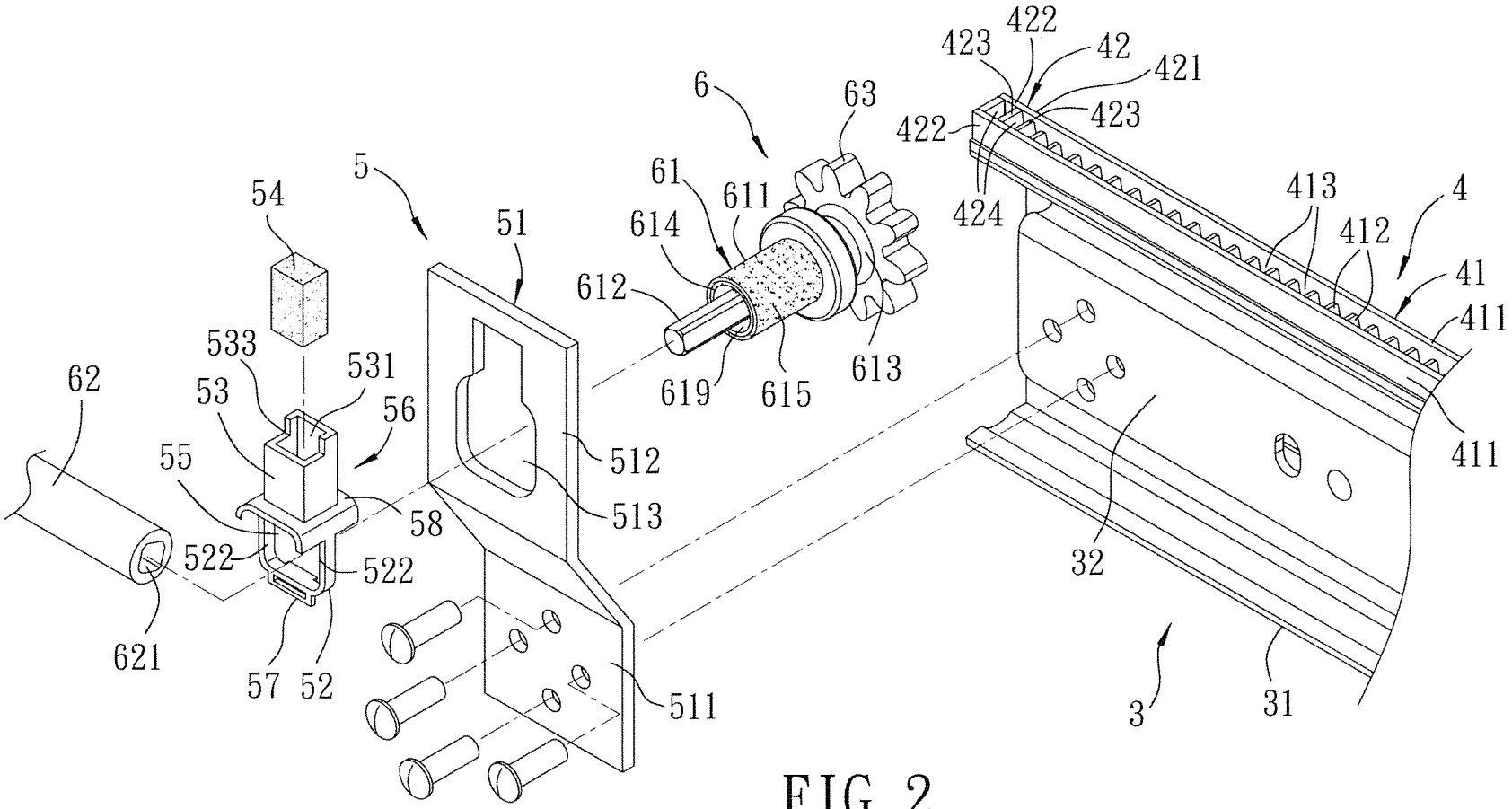
FIG. 2 is an exploded fragmentary perspective view illustrating the first preferred embodiment mounted on the drawer slide mechanism.
Figure 3:
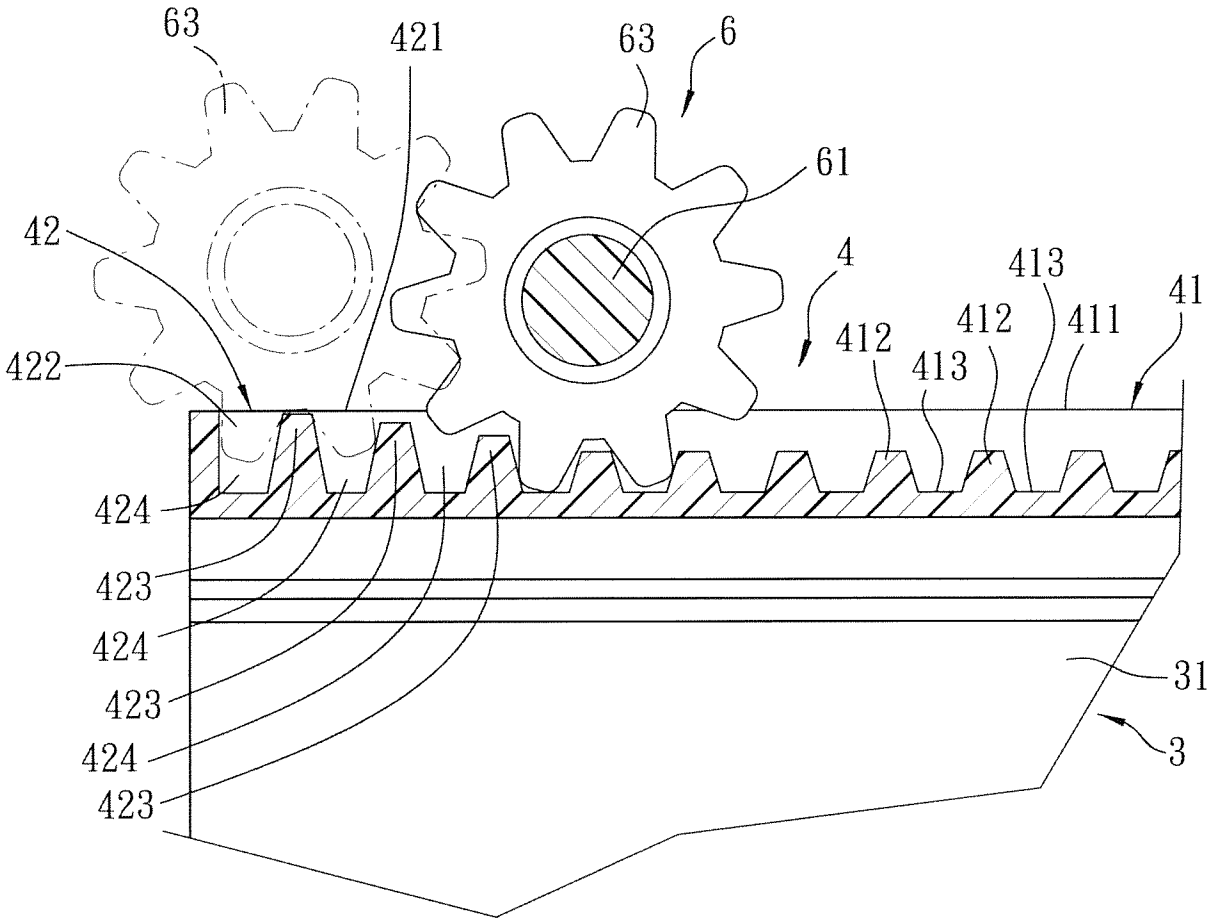
FIG. 3 is a fragmentary longitudinal sectional view of the first preferred embodiment.

Referring to FIGS. 2, 3, and 4, the rack member 41 has a pair of longitudinal and parallel retaining walls 411. The rack teeth 412 have substantially equal height, and are disposed between the retaining walls 411. The rack member 41 further has a plurality of rack grooves 413 that are formed among the rack teeth 412 and that have uniform depth. The toothed portion 421 has a pair of supporting walls 922 respectively and integrally connected to the retaining walls 411 in the same height, and a plurality of press teeth 423 that are aligned longitudinally with the rack teeth 412, that are higher than the rack teeth 412, and that are disposed between the supporting walls 422. The toothed portion 421 further has a plurality of press grooves 424 formed between the press teeth 423.

In this case, the press teeth 423 gradually increase in height from the rack teeth 412 in a direction away from the rack teeth 412 for slowing and damping the rotation of the rotating mechanism 6 (which will be detailed hereinafter). Of course, the height of the press teeth 423 may be incremented in a step-wise manner to control the relative motion of the rotating mechanism 6. Therefore, the present invention should not be limited to the disclosure of this embodiment. Besides, although three press teeth 423 are illustrated in the embodiment, the number of the press teeth 423 should not be limited in this respect. For example, the movement damper 42 may be provided with only one press tooth 423 in actual implementation.

As shown in FIG. 1, the rotating mechanism 6 includes a pair of movement-transmitting connectors 5 that are respectively installed on left and right sides of the drawer 2, and that are fixed on rear sides of the second slides 32 for moving together with the drawer. However, in actual implementation, the movement-transmitting connectors 5 may also be installed respectively on rear sides of the drawer 2. Each of the movement-transmitting connectors 5 includes a connecting plate 51 that is installed on the rear side of one of the second slides 32, a shaft support body 56 mounted in the connecting plate 51, and a lubricant body 54 disposed in the shaft support body 56 for abutting against a pinion shaft 61 of the rotating mechanism 6, which will be described hereinafter.

The connecting plate 51 has a fixing portion 511 riveted to the second slide 32, and a mounting portion 512 extending upwardly from the fixing portion 511. The mounting portion 512 is formed with a mounting opening 513, and the shaft support body 56 is mounted in the mounting opening 513. In this case, the shaft support body 56 has a journal portion 52 for journaling the pinion shaft 61, a lubricant supply portion 53 disposed integrally on a top of the journal portion 52 and at one side of the pinion shaft 61, a stop plate 58 disposed between the journal portion 52 and the lubricant supply portion 53, and a securing portion 57 extending from a bottom of the journal portion 52. The journal portion 52 and the stop plate 58 cooperatively define a journal hole 55. The journal portion 52 has two spaced-apart shaft-contact walls 522 facing towards the journal hole 55.

The lubricant supply portion 53 has a holding space 531 that is in spatial communication with the journal hole 55 and further has an engaging portion 533 extending from a top of the lubricant supply portion 53 for engaging the connecting plate 51. Of course, the holding space 531 may be formed in the journal portion 52 or another portion of the shaft support body 56 as long as the holding space 531 is in spatial communication with the journal hole 55. In this embodiment, the engaging portion 533 and the securing portion 57 of the shaft support body 56 are disposed one above the other to engage the mounting opening 513. However, as an alternative, the engaging portion 533 and the securing portion 57 may be arranged to engage left and right side edges of the mounting opening 513, or the shaft support body 56 and the connecting plate 51 may be integrally formed as one piece.

The lubricant body 54 is an oil-containing absorbent block made of cotton, sponge, or the like, which absorbs a lubricating oil. The lubricant body 54 is disposed in the holding space 531 and protrudes into the journal hole 55.

The rotating mechanism 6 further includes a pair of pinion shafts 61 each of which is rotatably mounted in the journal portion 52 of the movement-transmitting connector 5 to be in contact with the lubricant body 54, a spindle 62 interconnecting the pinion shafts 61 for synchronizing rotation of the pinion shafts 61, and a pair of pinion gears 63 that are respectively and integrally connected to the pinion shafts 61 and that are meshed respectively with the guiding units 4. Each pinion shaft 61 has a journal section 611 that is disposed in the mounting opening 513 near the lubricant supply portion 53, a spindle-connecting section 612 connected to the spindle 62, and a pinion-connecting section 613 connected to the corresponding pinion gear 63. The journal section 611 has a tubular part 614, and a non-rigid outer cover 615 surrounding the tubular part 614. The spindle-connecting section 612 extends coaxially inside the tubular part 614. The tubular part 614 and the spindle-connecting section 612 cooperatively define an annular insert space 619. The tubular part 614 is made of a rigid plastic, and the outer cover 615 is made of a soft material.

The lubricant body 54 can supply the lubricating oil continuously for a period. When the lubricating oil is exhausted, the lubricant body 54 may be refilled or replaced. With the use of the lubricant body 54, the journal section 611 will not encounter the prior art problem in which a lubricating oil applied to a journal shaft in a conventional manner is easily dried off by exposure to air and/or by a friction action of the journal shaft during its rotation even if a large amount of the lubricating oil is applied to the journal shaft.

The pinion-connecting section 612 has a non-circular cross section. The spindle 62 has two opposite engaging holes 621 at ends thereof for receiving the spindle-connecting sections 612, respectively. Each of the engaging holes 621 has a non-circular cross sectional shape complementary with the cross section of the corresponding spindle-connecting section 612. Both ends of the spindle 62 are inserted into the annular spaces 619 so that the pinion shafts 61 are not rotatable relative to the spindle 62. Because the spindle 62 is surrounded by the tubular part 614 and receives the spindle-connecting section 612 of each pinion shaft 61, when the pinion shafts 61 are assembled on the movement-transmitting connectors 5 by extending through the journal portions 52 or the journal holes 55, the spindle 62 can be centered properly with respect to the axis of rotation of the spindle-connecting section 612 and the journal section 611 and will not rotate eccentrically. Accordingly, the pinion gears 63 may be prevented from moving in an unbalanced manner on the rack members 41.

Each pinion gear 63 engagingly moves on the rack teeth 412 and the press teeth 423 for rotating on the guiding unit 4. By virtue of the retaining and supporting walls 411, 422, the pinion gear 63 is prevented from separating from the guiding unit 4, thereby reducing a possibility of malfunction. While the retaining and supporting walls 411, 422 are used in this embodiment to restrict and prevent the pinion gear 63 from separating from the guiding unit 4, the retaining and supporting walls 411, 422 may be omitted in actual implementation. The present invention should not be limited to the specific details described herein.

When the rotating mechanism 6 is moved from the rear end to the front end of the guiding unit 4 for assembly, the movement thereof can be impeded by the toothed portions 421 of the movement dampers 42 at the rear end of the second slides 32. Under this condition, an external force may be applied to force the two pinion gears 63 to move past the respective toothed portions 921 and to move to the respective rack members 41 at aligned positions such that positional deviation can be avoided.

Referring to FIGS. 1, 3, and 4, when a user pulls the drawer 2, the drawer 2 drives movement of the second slides 32 of the drawer slide mechanisms 3, the second slides 32 thus move together with the movement-transmitting connectors 5 for moving synchronously the pinion gears 63 of the rotating mechanism 6. When the pinion gears 63 engagingly move on the respective rack members 41, revolutions or rotating angles of the two pinion gears 63 are substantially the same, thereby ensuring synchronous movement of the two second slides 32 on two sides of the drawer 2. Therefore, a swerving problem can be avoided even if an uneven force is applied to the drawer 2.

Figure 5:
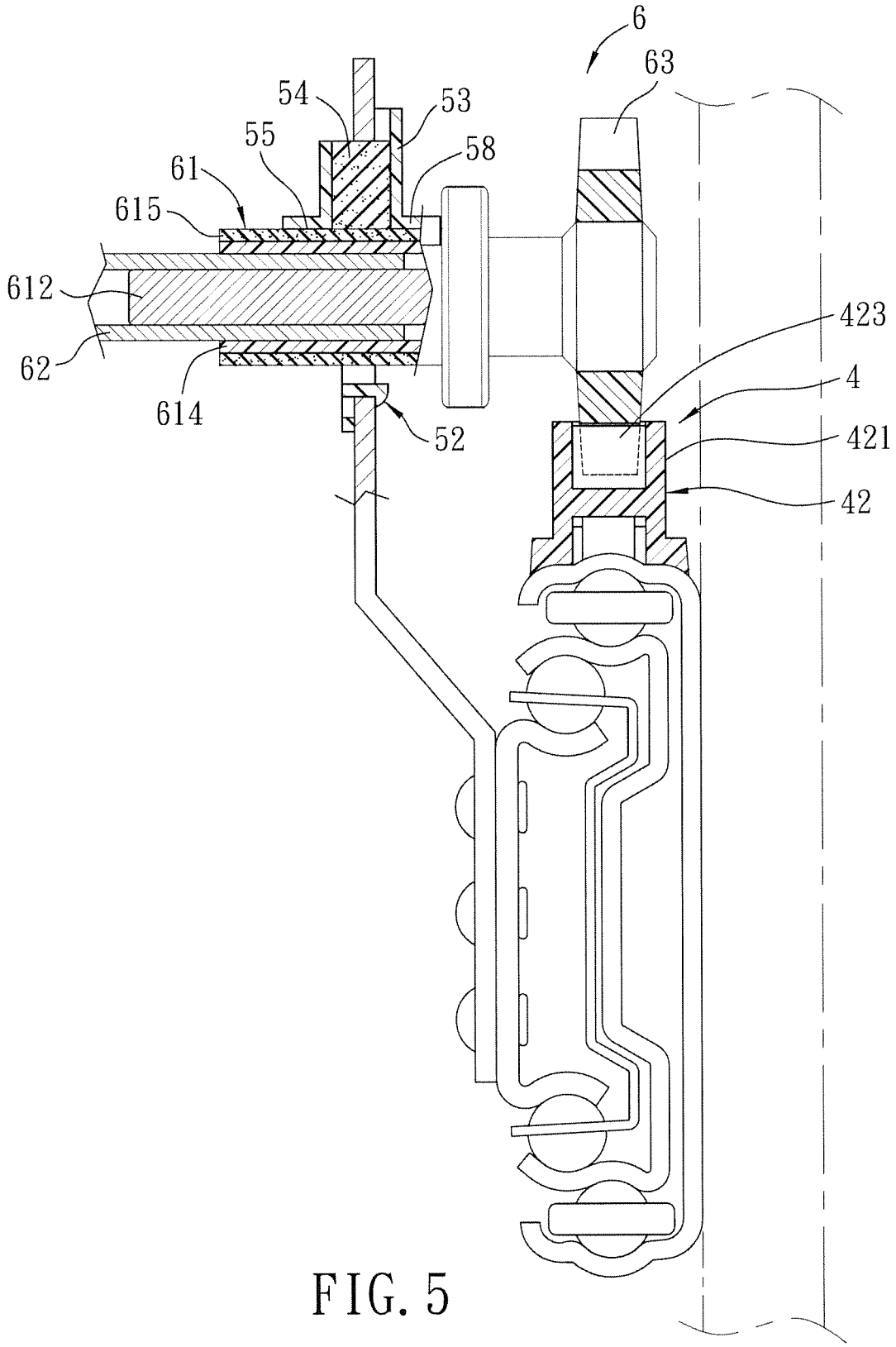
FIG. 5 is the same view as FIG. 4, but illustrating that the pinion gear is meshed with a movement damper of the guiding unit.

Referring to FIGS. 1, 3, and 5, when the drawer 2 is either fully closed or fully opened, the pinion gears 63 respectively move to the toothed portions 421 of the movement dampers 42. The pinion gears 63 are gradually elevated by the press teeth 423 when moving in a direction away from the rack teeth 411. At the same time, each pinion shaft 61 moves gradually upward in the respective journal hole 55 and abuts against the respective stop plate 58 more and more tightly so that an increased pressure is produced between the toothed portions 421 of the movement dampers 42 and the pinion gears 63. Friction between each toothed portion 421 and the corresponding pinion gear 63 is therefore increased for slowing down the moving speed of the rotating mechanism 6. The rotating mechanism 6 is fully stopped when the pinion gear 63 fully stops at one end of the corresponding toothed 421 as shown by the phantom line in FIG. 3, thereby avoiding impact and noise.

Referring to FIGS. 2, 3, and 4, the cross section of each pinion shaft 61 is not exactly circular because the pinion shaft 61 is made by an injection molding process and because injection molded articles can deform due to shrinkage. As the pinion shaft 61 is not circular, continuous impact noise may occur as the stop plate 58 drives rotation of the pinion shaft 61 in a press and limitation manner. In the present invention, the non-rigid outer cover 615 of the pinion shaft 61 is made of a soft material and contacts rollingly and cushioningly the hard journal portion 52. Therefore, noise can be eliminated, thereby prolonging the service life of the pinion shaft 61, and increasing the effect of damping and impeding abrupt movements. Referring to FIGS. 2, 3, and 5, when the pinion gear 63 moves to the toothed portion 421 and the pinion shaft 61 abuts tightly against the stop plate 55, the outer cover 615 may deform and prevent noise caused between the pinion shaft 61 and the journal portion 52. When the pinion gear 63 moves away from the movement damper 42, the soft outer cover 615 can restore back to its original shape that benefits rotation of the pinion shaft 61.

Besides, the pinion shaft 61 abuts against the shaft-contact wall 522 of the corresponding shaft support body 56 and rotates in the journal space 55 when being pushed by the shaft-contact wall 522 that moves along with the second slide 32 and the drawer 2. The upper side of the pinion shaft 61 is in contact with the lubricant body 54 to keep a lubricated condition between the pinion shaft 61 and the stop plate 58, and between the pinion shaft 61 and the journal portion 52, which reduces friction abrasion and enhances smooth rotation of the pinion shaft 61 when the pinion shaft 61 is rotated relative to the movement dampers 42 and is pressed by the stop plate 58. Therefore, noise is reduced and the service life of the synchronizing device is prolonged.

When the pinion gear 63 moves on the toothed portion 421 of the guiding unit 4, the toothed portion 421 gradually elevates the pinion gear 63 to lift the pinion shaft 61 toward the stop plate 58, so that the pinion shaft 61 is gradually pressed by the stop plate 58 and the rotation of the pinion shaft 61 is slowed down and finally stopped. For avoiding noise caused by the rotation of the non true circular pinion shaft 61, the outer cover 615 is provided to surround the outer periphery of the tubular part 614.

Moreover, when the pinion gear 63 moves on the toothed portion 421, the stop plate 58 gradually presses the pinion shaft 61. At this time, a lubricant is needed between the pinion shaft 61 and the stop plate 58 for reducing friction and avoiding wear and abrasion attributed to rotation and abutment. In case the lubricant is simply applied to the pinion shaft 61 in a conventional manner, it can dry off easily by air and by a friction action during rotation of the pinion shaft 61. Since the lubricant body 54 is able to keep a constant lubricating action between the pinion shaft 61 and the stop plate 58, the lubricant will not be easily air-dried off, thereby avoiding wear and abrasion.

In addition, although the tubular part 614 is covered by the outer cover 615 to reduce noise, through confirmations of physical properties and practical tests, the outer cover 615 has a high friction coefficient that may impede the pressed and abutted rotation of the pinion shaft 61. According to this invention, the lubricant body 54 can lubricate an outer periphery of the outer cover 615 for a long time to avoid the impediment of rotation and enhance rotation of the pinion shaft 61.

In other words, by the coordination of the toothed portion 421 of the guiding unit 4, the outer cover 615, and the lubricant body 54, the synchronizing device has the effects of lowering noise and friction in an abrasion-less and abrupt movement-less manner, and slowing down the speed of the pinion gears 63.

Figure 6:
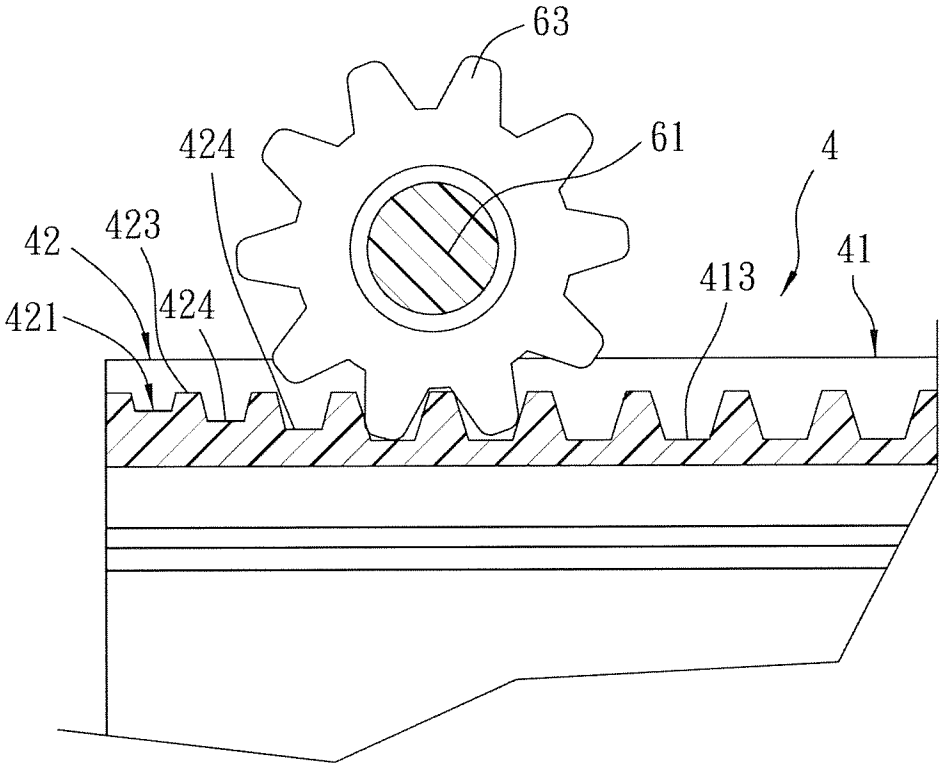
FIG. 6 is a fragmentary sectional view illustrating a second preferred embodiment of the present invention.

FIG. 6 show a second preferred embodiment of the synchronizing device according to this invention, which has a structure generally similar to that of the first preferred embodiment. However, the press grooves 424 of the toothed portion 421 have a depth that is smaller than that of the rack grooves 413 and that decreases gradually in a direction away from the rack grooves 413. The press teeth 423 are as high as the rack teeth 412. When the pinion gear 63 moves to the movement damper 42, the press grooves 424 gradually lift the pinion gear 63 and the pinion shaft 61 abuts against the stop plate 58, thereby reducing relative motion therebetween. While the depth of the press grooves 424 is gradually decreased in this embodiment, the present invention should not be limited thereto. In actual application, a distance between two adjacent ones of the press grooves 424 may be gradually decreased, and the width of the press teeth 423 may be gradually increased to achieve the effect of lifting the pinion gear 63.

Figure 7:
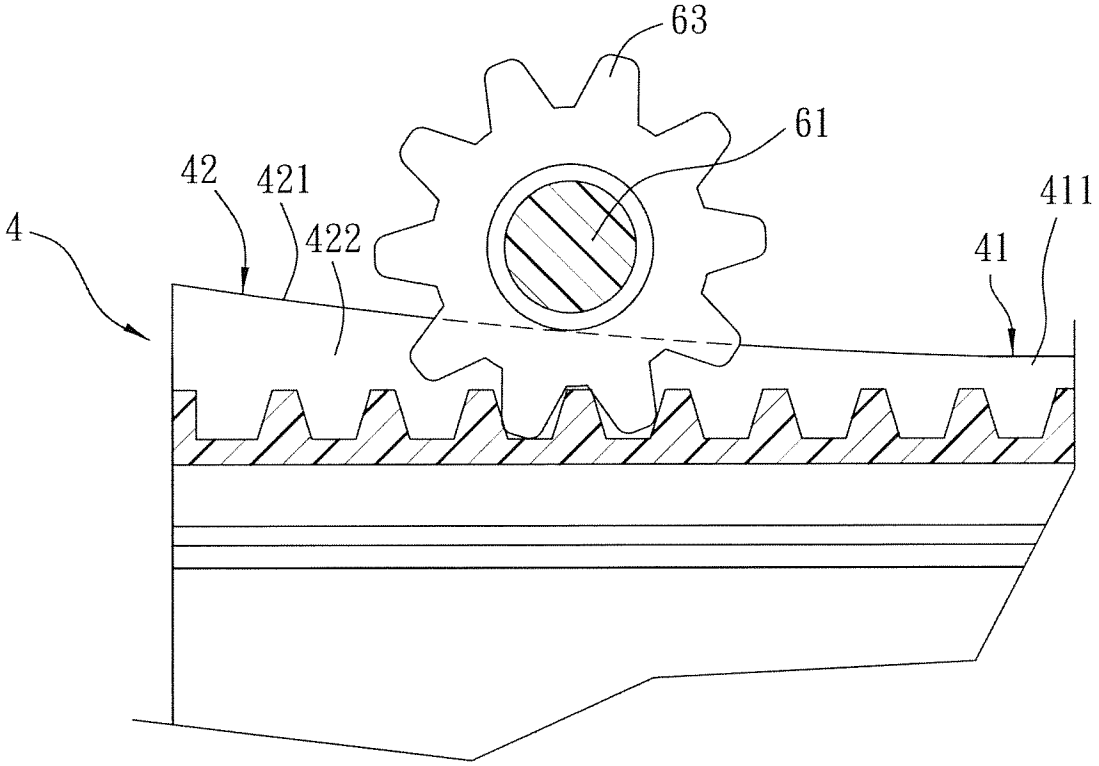
FIG. 7 is a fragmentary longitudinal sectional view illustrating a third preferred embodiment of the present invention.
Figure 8:
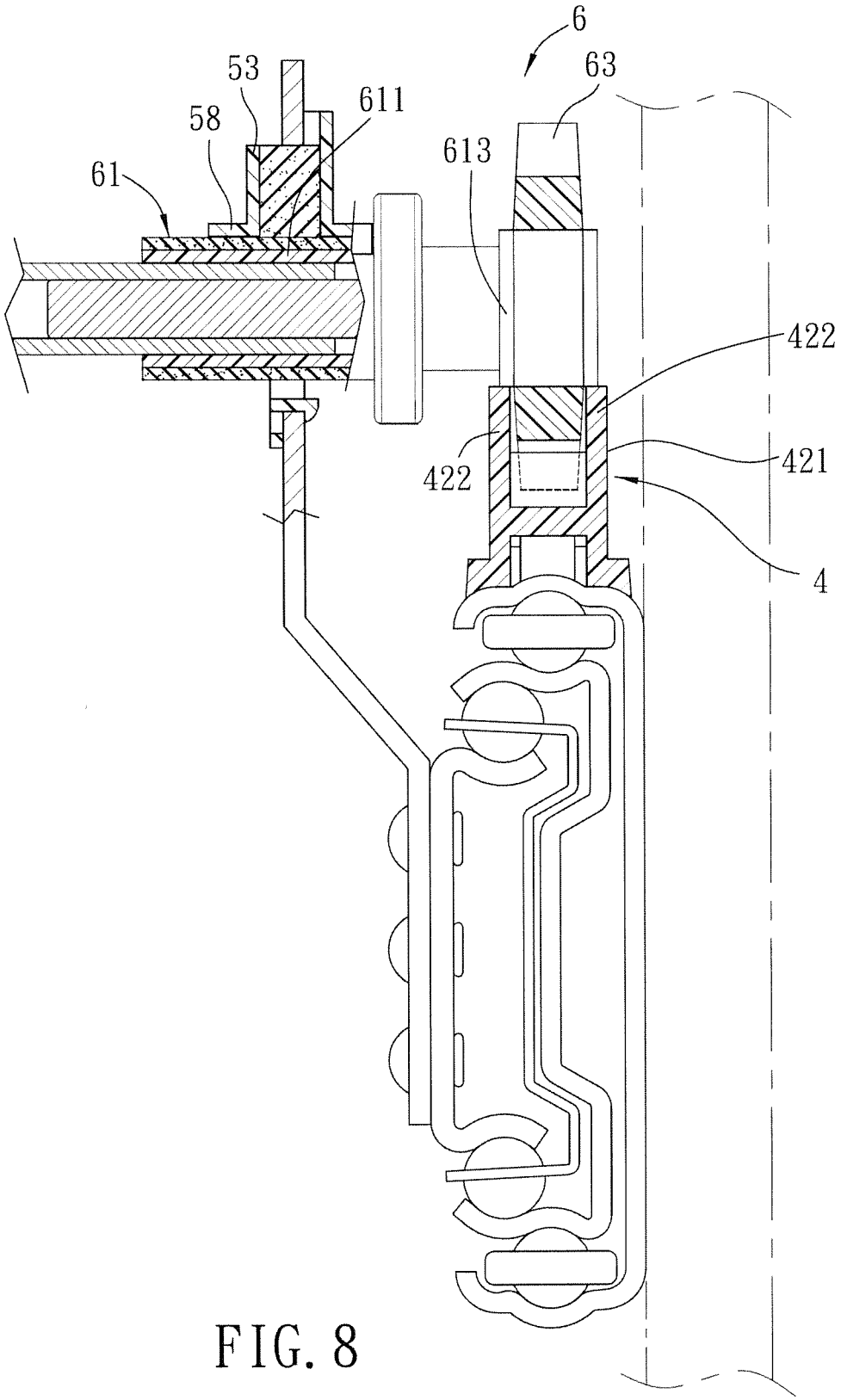
FIG. 8 is a fragmentary transverse sectional view illustrating the third preferred embodiment.

FIGS. 7 and 8 show the third preferred embodiment of the synchronizing device according to this invention, which has a structure generally similar to that of the first preferred embodiment. However, the supporting walls 422 of the toothed portion 421 are gradually increased in height from the retaining walls 411 in a direction away from the retaining walls 411. When the pinion gear 63 moves to the toothed portion 421, the pinion-connecting section 613 of the pinion shaft 61 is gradually elevated by the supporting wall 422 so that the journal section 611 gradually abuts against the stop plate 58, thereby reducing the relative motion of the rotating mechanism 6.

Figure 9:
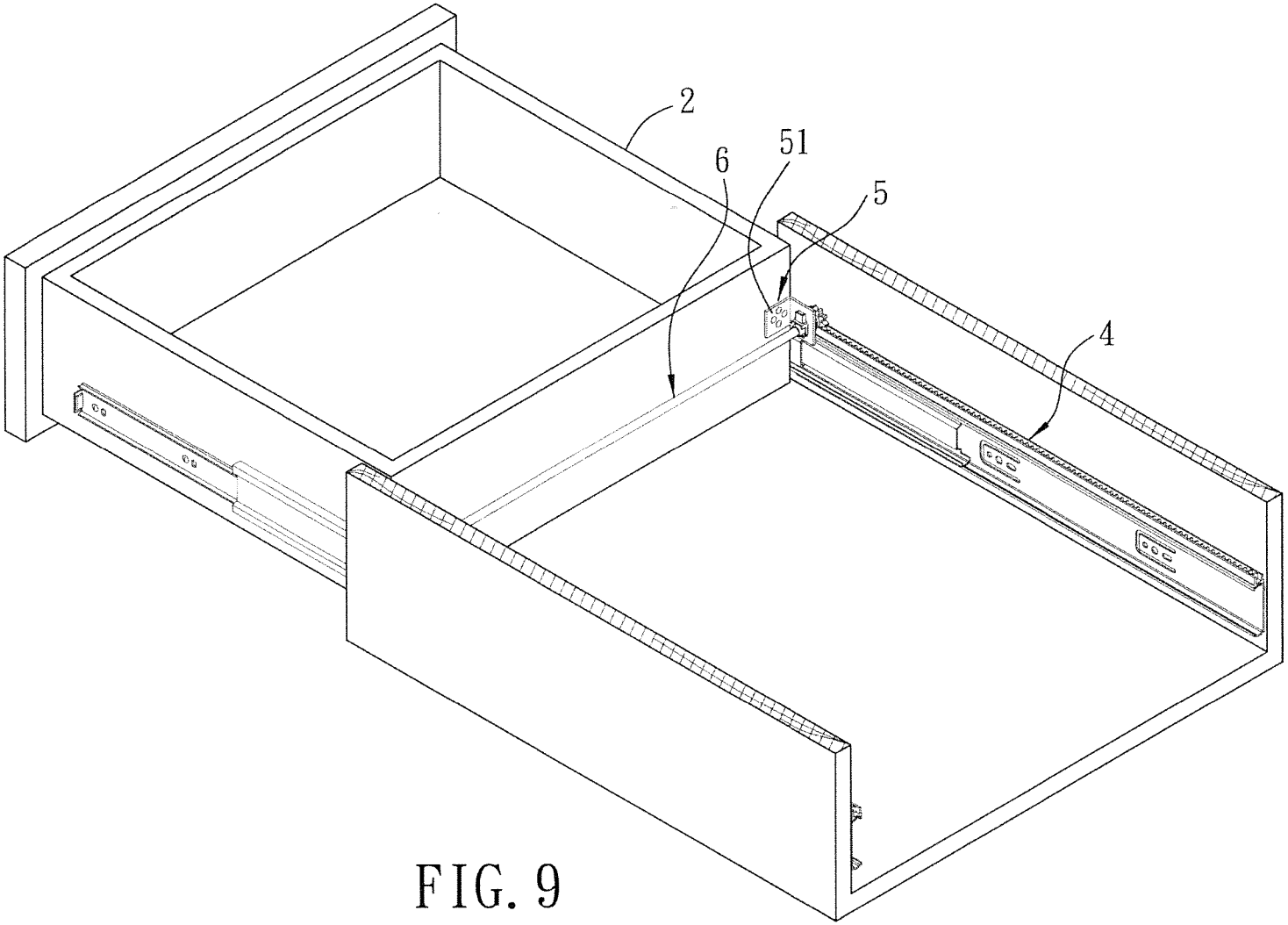
FIG. 9 is a perspective view illustrating a drawer, a drawer slide mechanism, and a fourth preferred embodiment of a synchronizing device according to the present invention.
Figure 10:
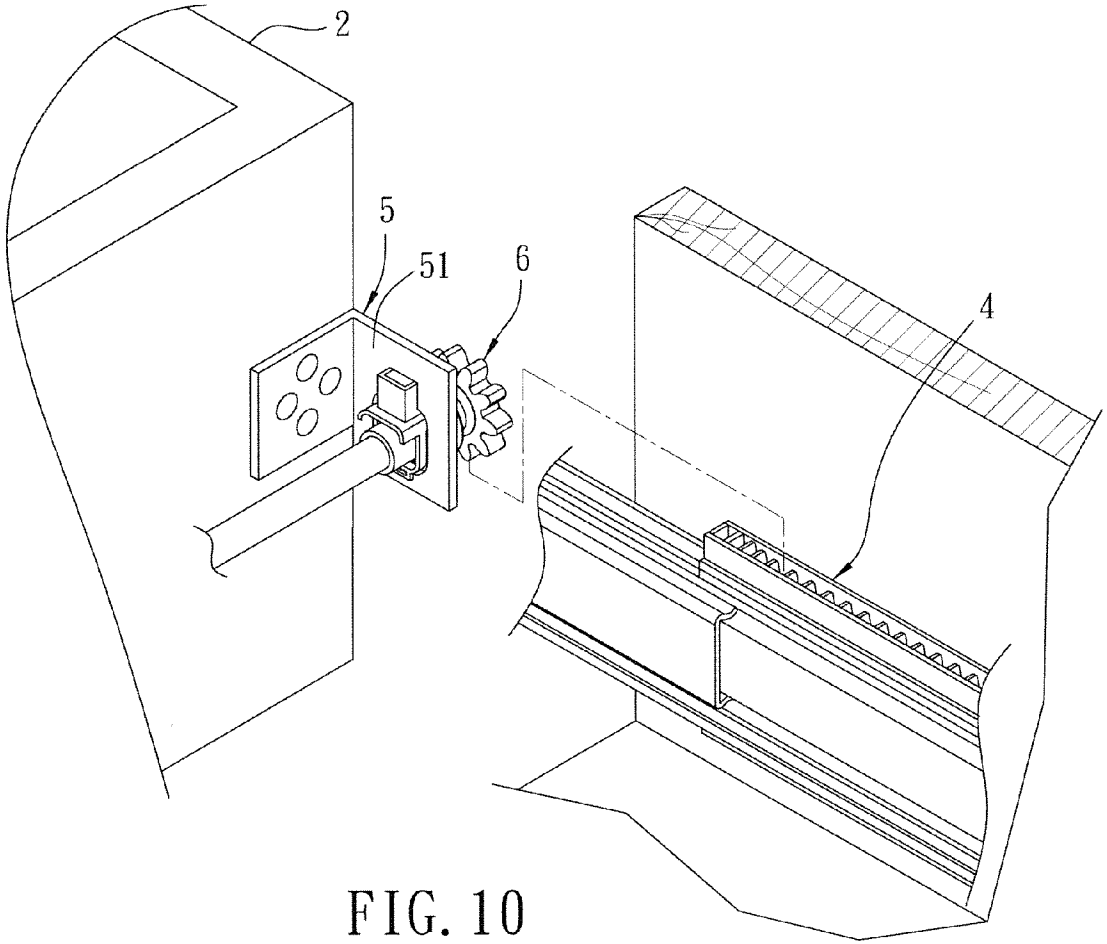
FIG. 10 is a fragmentary perspective view illustrating the fourth preferred embodiment.

FIGS. 9 and 10 show the fourth preferred embodiment of a synchronizing device according to this invention, which has a structure generally similar to that of the first preferred embodiment. However, the disposition of the movement-transmitting connectors 5 is modified. In this embodiment, the connecting plate 51 of each movement-transmitting connector 5 is fixed on the rear side of the drawer 2 to connect to the rotating mechanism 6 and to move together with the drawer 2.

Figure 11:
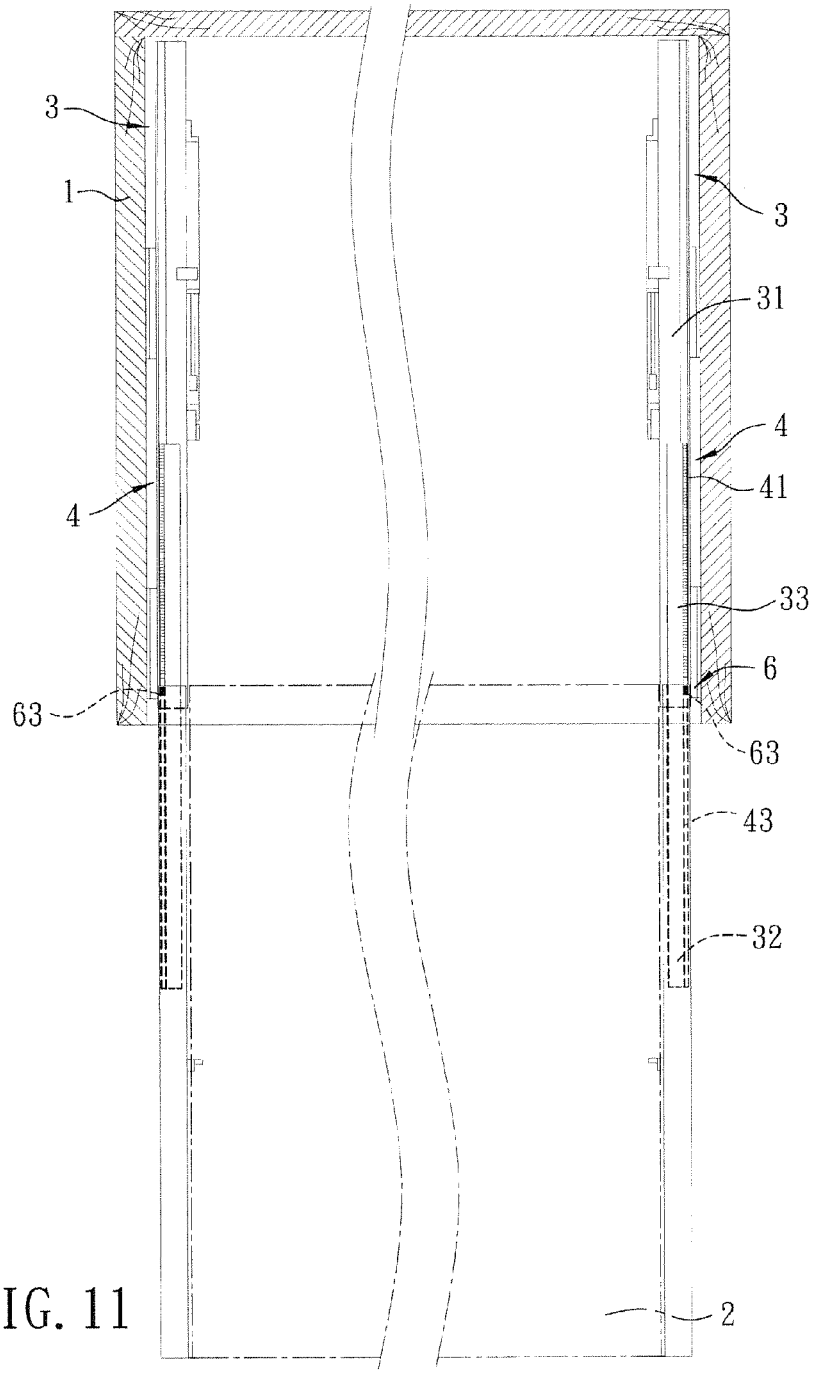
FIG. 11 is a fragmentary sectional top view illustrating a fifth preferred embodiment of a synchronizing device according to the present invention.
Figure 12:
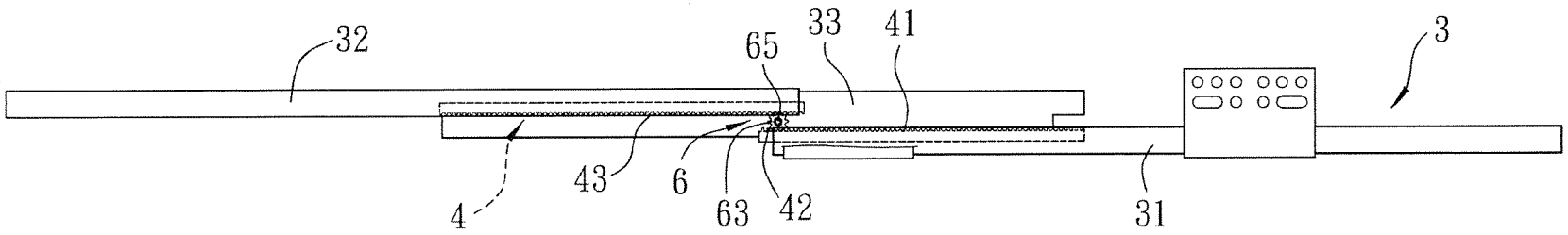
FIG. 12 is a side view of the fifth preferred embodiment.
Figure 13:
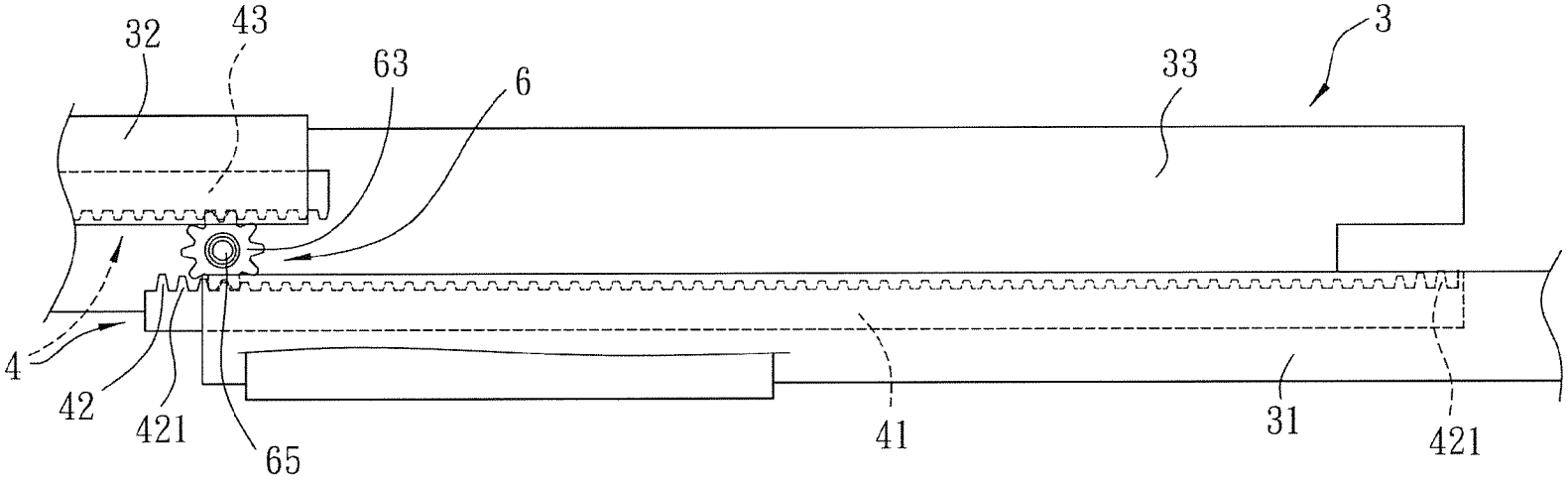
FIG. 13 is an enlarged fragmentary view illustrating a portion of the fifth preferred embodiment shown in FIG. 12.

FIGS. 11 to 13 show the fifth preferred embodiment of a synchronizing device according to this invention. In this embodiment, the rotating mechanism 6 includes a pair of pinion shafts 65 each disposed on the corresponding intermediate slide 33 and connected to the corresponding pinion gear 63. The guiding unit 4 has two pairs of spaced-apart upper and lower rack members 43, 41, and two movement dampers 42 respectively disposed on two ends of the lower rack member 41 for reducing a relative motion of the corresponding pinion gear 63 between the upper and lower rack members 43, 41.

The lower rack member 41 is installed on an inner side of the first slide 31 of the drawer slide mechanism 3. The upper rack member 43 is installed on an inner side of the second slide 32 of the drawer slide mechanism 3. Each pinion gear 63 is installed on the corresponding intermediate slide 33 for meshing with the corresponding upper and lower rack members 43, 41.

One toothed portion 412 is integrally connected to a front end of the lower rack member 41. Another toothed portion 412 is integrally connected to a rear end of the lower rack member 41. However, in actual implementation, the toothed portions 421 may be disposed on the upper rack member 43. Alternatively, one of the toothed portions 421 may be connected to the lower rack member 41 and the other of the toothed portions 421 may be connected to the upper rack member 43. In addition, the number of the toothed portions 421 may be reduced. For example, there may be only one toothed portion 421 connected to the front end of one of the upper and lower rack members 43, 41, or connected to the rear end of one of the upper and lower rack members 43, 41. However, the present invention is not limited in this respect.

When the user pulls the drawer 2, the drawer slide mechanisms 3 are actuated for moving relative to the caddy 1 in the front to rear direction. Therefore, each second slide 32 moves together with the corresponding upper rack member 43, which engages the corresponding pinion gear 63, thereby synchronously moving the corresponding intermediate slide 33. When the drawer 2 is fully opened or fully closed, each pinion gear 63 moves to one of the toothed portions 421, and is gradually elevated thereon, so that each pinion shaft shaft 65 is pressed and abuts against the corresponding movement damper 42. The motion of each pinion gear 63 is slowed down and finally stopped at the end of the corresponding movement damper 42, thereby avoiding impact and reducing noise.

Figure 14:
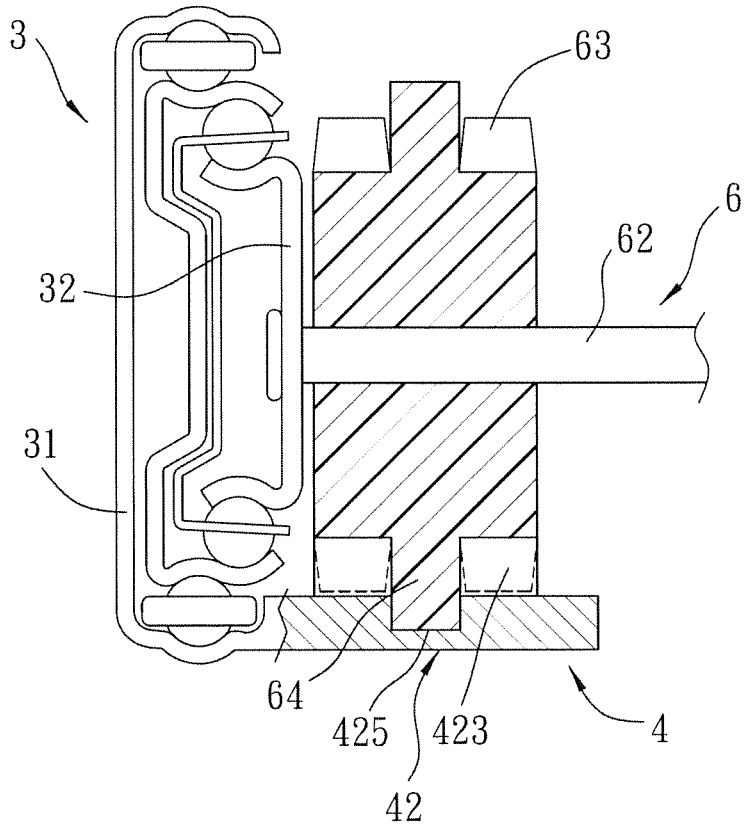
FIG. 14 is a fragmentary front sectional view of a sixth preferred embodiment according to the present invention.
Figure 15:
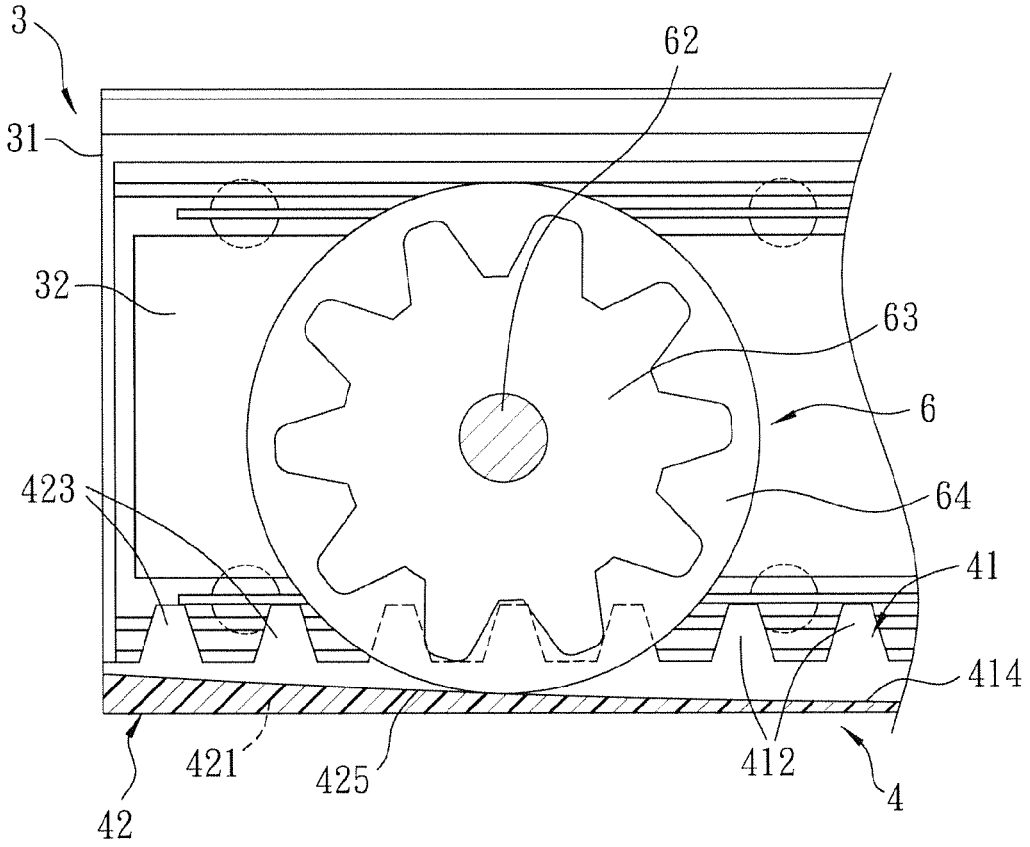
FIG. 15 is an enlarged fragmentary side sectional view illustrating the sixth preferred embodiment.

FIGS. 14 and 15 show the sixth preferred embodiment of a synchronizing device according to this invention, which has a structure generally similar to that of the third preferred embodiment. However, the movement-transmitting connectors 5 are omitted, and the structures of the guiding unit 4 and the rotating mechanism 6 are modified.

The rack member 41 of the guiding unit 4 is connected to a lower part of an inner side of the first slide 31, and further has a longitudinal sliding groove 414 that intersects the rack teeth 412 and that is indented downwardly from center points of tip ends of the rack teeth 412. The rack teeth 412 are therefore divided into left and right rows. The movement damper 42 further has an inclined groove 425 that intersects the press teeth 423, that is indented downwardly from tip ends of the press teeth 423 and that is connected longitudinally and continuously to the sliding groove 414. The inclined groove 425 has a depth that is smaller than that of the sliding groove 414 and that decreases gradually from the sliding groove 414 in a direction away from the sliding groove 414. Of course, the guiding unit 4 may alternatively be configured so as to be composed of separate components. For example, two spaced-apart left and right rack members may be disposed on two sides of a longitudinal groove corresponding to the sliding and inclined grooves 414, 425. However, the present invention is not limited in this respect.

The spindle 62 has two opposite ends (only one end is shown) respectively and rotatably connected to the second slides 32. Each pinion gear 63 has a cam wheel portion 64 radially protruding from a middle part of the pinion gear 63. The cam wheel portion 64 divides the teeth of the pinion gear 63 into left and right regions, and is rotatable in the sliding groove 414. In actual implementation, the pinion gear 63 and the cam wheel portion 64 may be composed of separate components. For example, one cam wheel may be sandwiched between two pinion gears. However, the present invention is not limited in this respect.

As shown in FIGS. 14 and 15, when the pinion gear 63 engagingly moves on the rack member 41, the cam wheel portion 64 rotates in the sliding groove 414. When the pinion gear 63 moves to the movement damper 42, the cam wheel portion 64 is elevated by the inclined groove 425, so that the spindle 62 is raised and abuts more and more tightly against a top edge (not shown) bounding a journal hole (not shown) formed in the second slide 32 and the speed of the pinion gear 63 is slowed down gradually.

Figure 16:
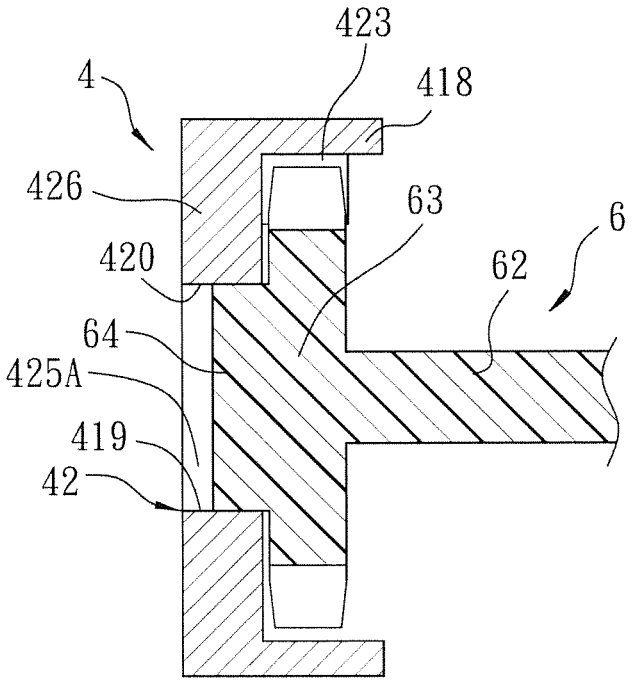
FIG. 16 is an enlarged fragmentary front sectional view of a seventh preferred embodiment of a synchronizing device, illustrating a pinion gear meshed with a movement damper.
Figure 17:
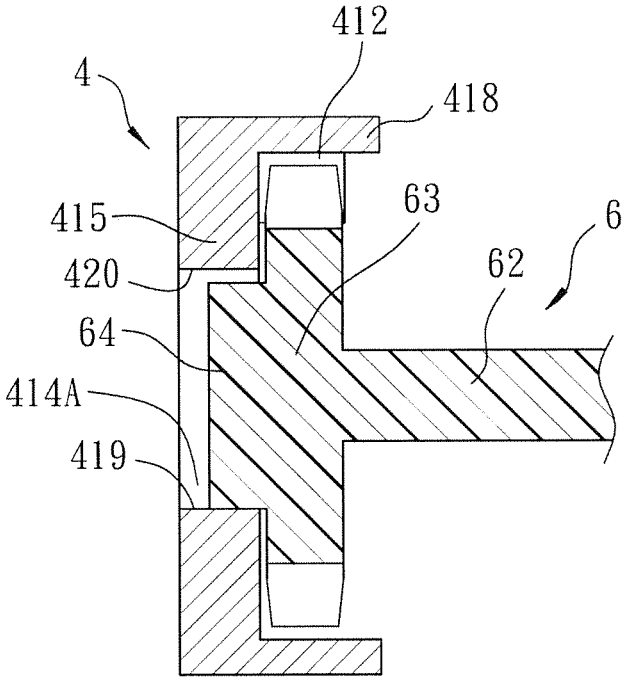
FIG. 17 is another enlarged fragmentary front sectional view of the seventh preferred embodiment, illustrating the pinion gear meshed with a rack member.
Figure 18:
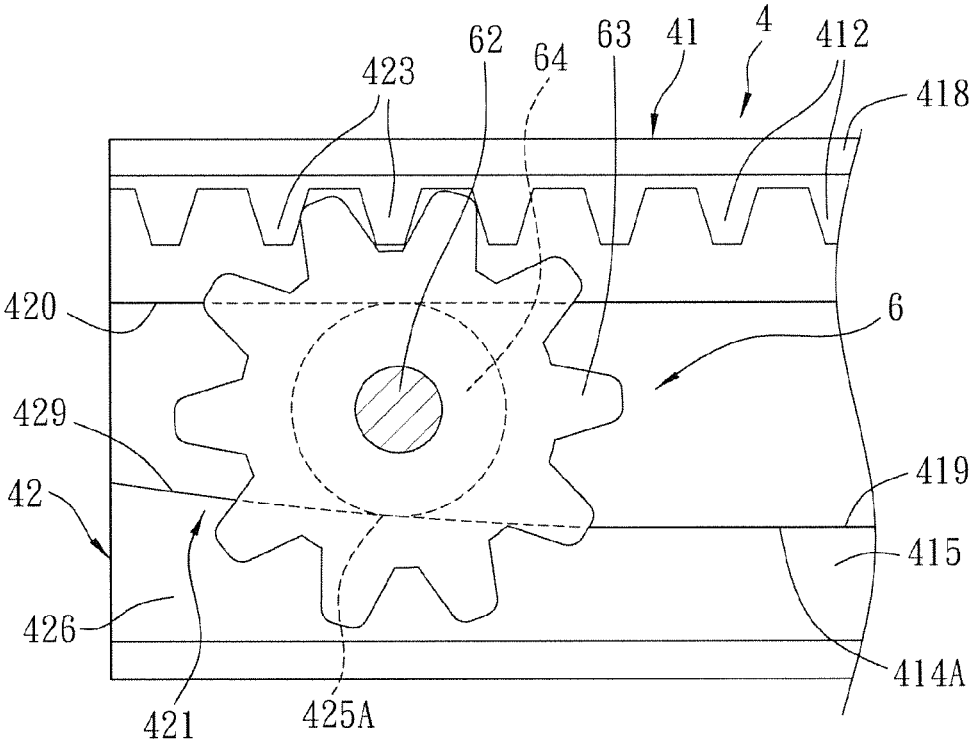
FIG. 18 is an enlarged fragmentary side view illustrating the pinion gear meshed with the movement damper of the seventh preferred embodiment.
Figure 19:
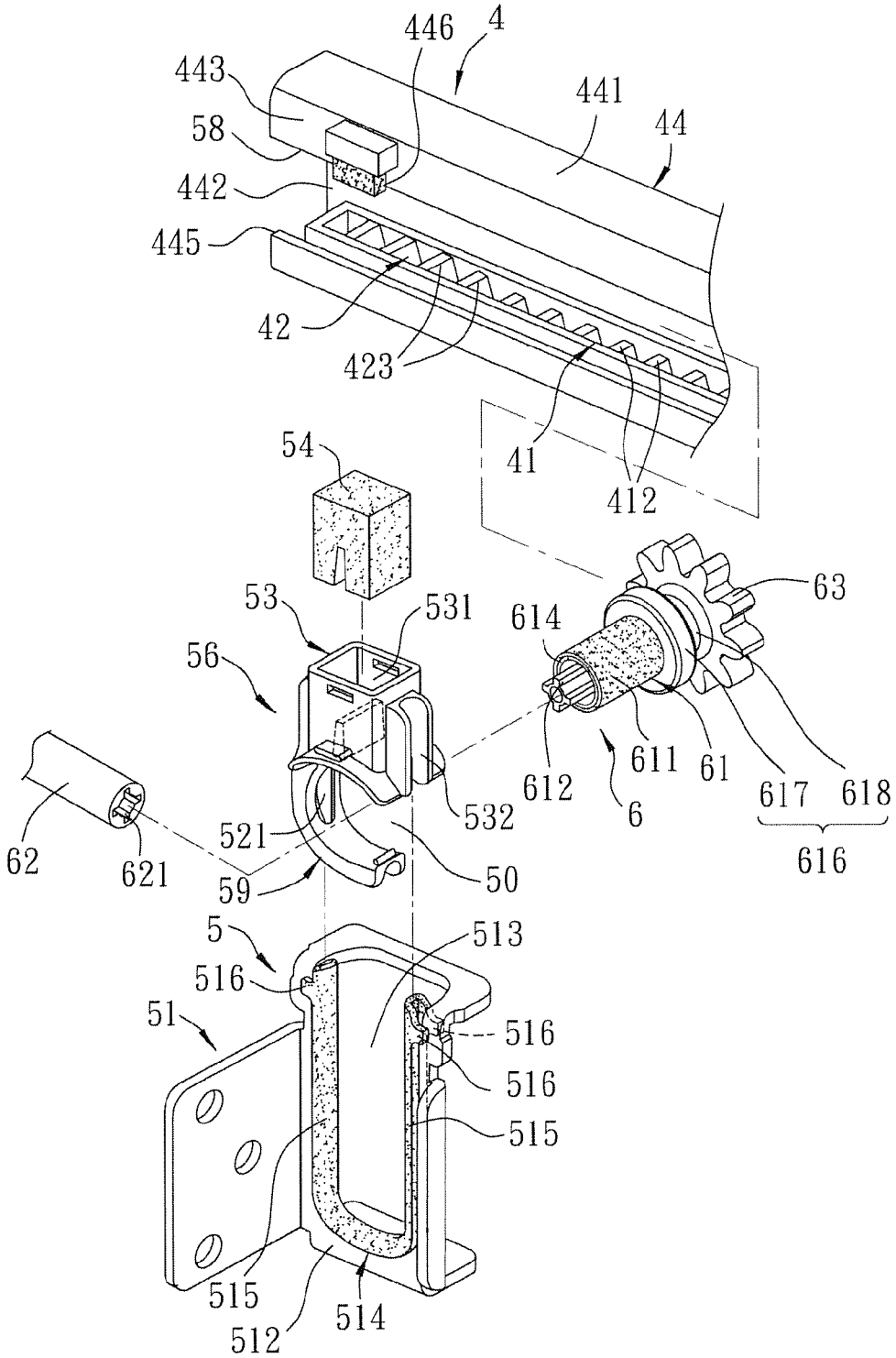
FIG. 19 is an exploded fragmentary perspective view illustrating an eighth preferred embodiment of a synchronizing device according to the present invention.
Figure 20:
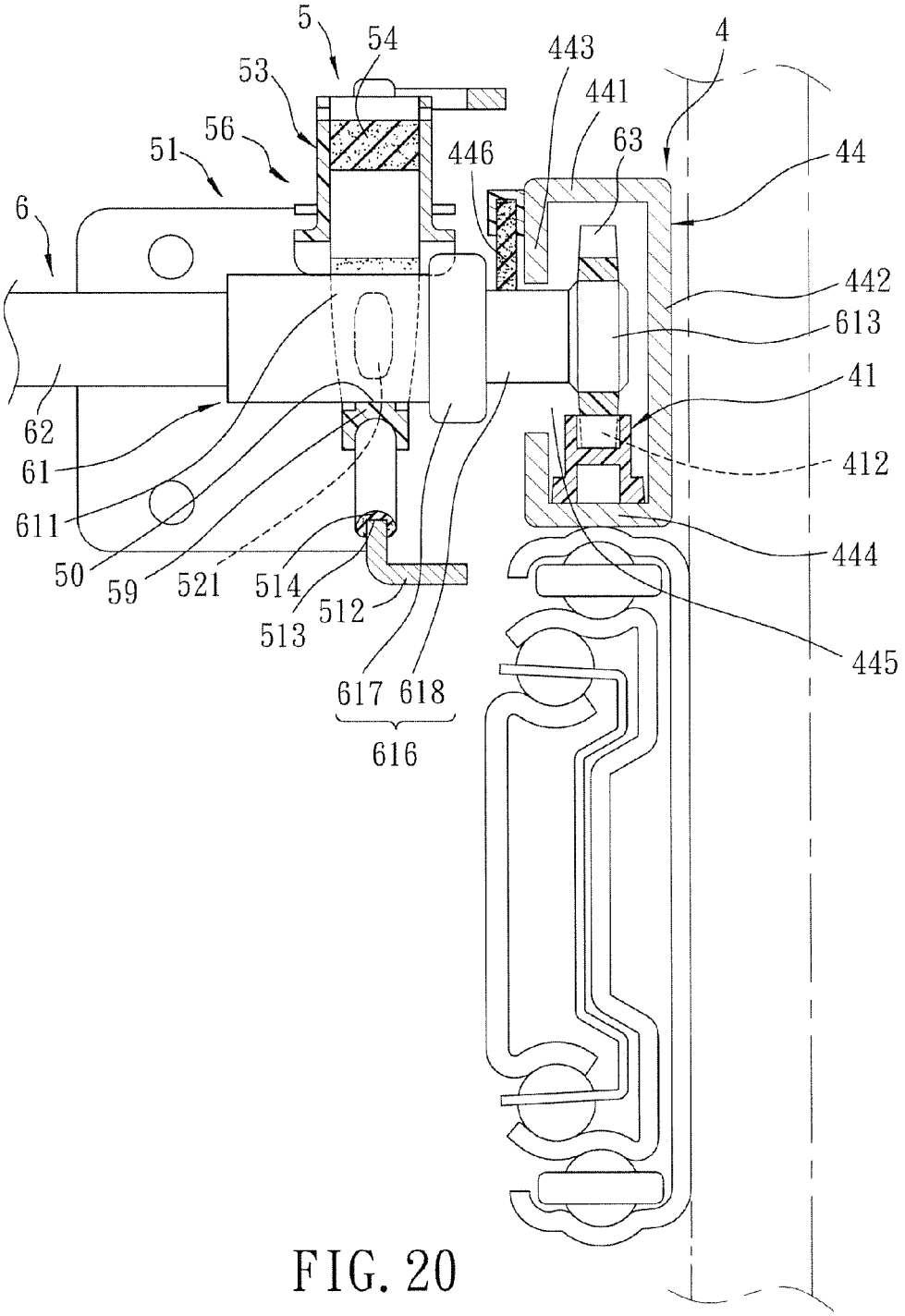
FIG. 20 is a fragmentary transverse sectional view illustrating the eighth preferred embodiment.
Figure 21:
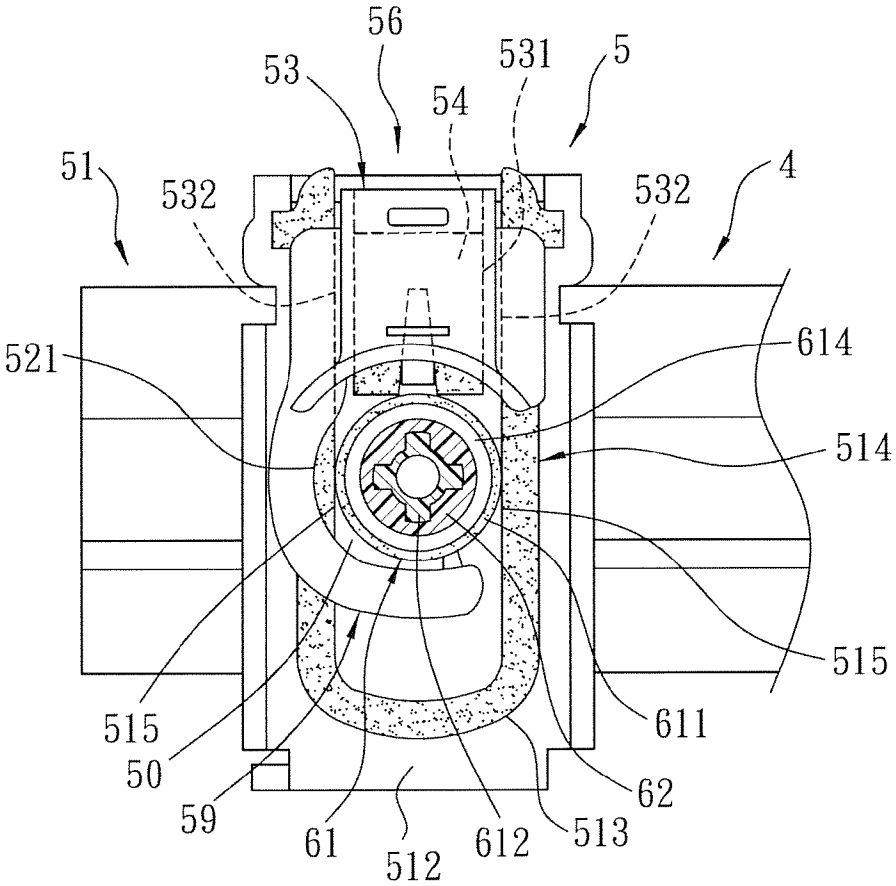
FIG. 21 is a fragmentary sectional view illustrating a lubricant body and a pinion shaft of the eighth preferred embodiment.

FIGS. 16 to 18 show the seventh preferred embodiment of a synchronizing device according to this invention, which has a structure generally similar to that of the movement-transmitting connectors 5 are omitted, and the structures of the guiding unit 4 and the rotating mechanism 6 are modified.

In this embodiment, the rack teeth 412 and the press teeth 423 protrude in a downward direction. Each rack member 41 further has a horizontally extending longitudinal base wall 418 formed with the rack teeth 412, a sliding wall 415 that is connected transversely to the base wall 418 to extend vertically at one side of the rack teeth 412, and a longitudinal sliding hole 414A formed in the sliding wall 415. The toothed portion 421 further has a plurality of the press teeth 423 formed on the base wall 418 and connected integrally to and aligned longitudinally with the rack teeth 412, a guiding wall 426 that is connected longitudinally to and that extends continuously from the sliding wall 115, an inclined hole 425A formed in the guiding wall 426 and connected longitudinally to the sliding hole 414A, and a stop face 420 bounding the sliding hole 414A and the inclined hole 425A. The inclined hole 425A has a width smaller than that of the sliding hole 414A so that a lower edge 419 bounding the inclined hole 425A is gradually increased in height from a lower edge 419 bounding the sliding hole 414A in a direction away from the sliding hole 414A.

In this embodiment, the rotating mechanism 6 has a cam wheel 64 connected to the pinion gear 63. When the pinion gear 63 slides on the rack teeth 412 of the rack member 41, the cam wheel 64 rotates in the sliding hole 414A along a direction of the rack member 41. When the pinion gear 63 moves to the movement damper 42, the cam wheel 64 rotates in the inclined hole 425A and is elevated gradually to abut more and more tightly against the stop face 420 above the inclined hole 425A, thereby slowing down the speed of the pinion gears 63.

FIGS. 19 to 22 show an eighth preferred embodiment of a synchronizing device according to this invention, which has a structure generally similar to that of the fourth preferred embodiment. In this embodiment, the pinion shaft 61 of the rotating mechanism 6 has the journal section 611, the spindle-connecting section 612, the pinion-connecting section 613, and a connection portion 616 connecting the journal section 611 and the pinion-connecting section 613. The connection portion 616 has an annular flange 617 that connects to and projects radially from the journal section 611, and a neck section 618 that interconnects the annular flange 617 and the pinion-connecting section 613 and that is indented radially therebetween.

Each guiding unit 4 further has a channel member 44 to receive the rack member 41 and the movement damper 42. The channel member 44 has a substantially C-shaped cross section. Moreover, the channel member 44 has a longitudinal top wall 441 extending above the rack teeth 412 and the press teeth 423, a bottom wall 444 extending below the rack teeth 412 and the press teeth 423, a connecting wall 442 extending downwardly from one end of the top wall 441 and at one side of the rack teeth 412 and the press teeth 423 to connect to the bottom wall 444, a channel opening 445 formed at another side of the rack teeth 412 and the press teeth 423 oppositely of the connecting wall 442, and a limit wall 443 extending downwardly from another end of the top wall 441 to the channel opening 445. The limit wall 443 is disposed above the neck section 618 and between the annular flange 617 and the pinion-connecting section 613 so that the pinion gear 63 is able to move longitudinally and stably along the guiding unit 4 without jumping off or swerving from the guiding unit 4.

Figure 22:
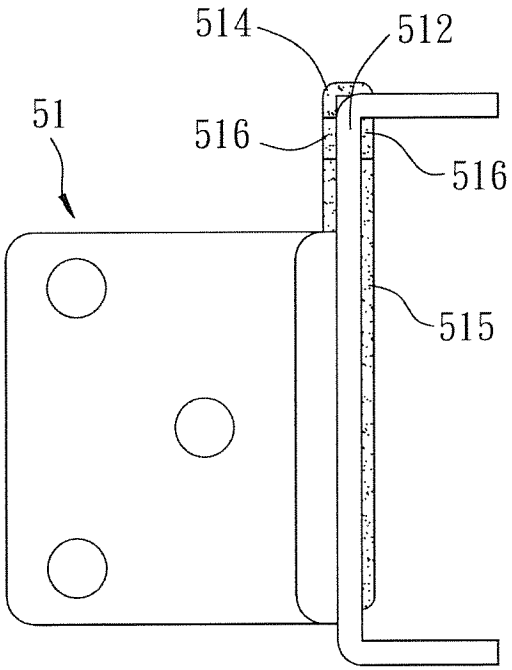
FIG. 22 is partly sectional view illustrating a mounting plate of a movement-transmitting connector of the eighth preferred embodiment.

In this embodiment, the connecting plate 51 of each movement-transmitting connector 5 has the mounting portion 512 with an upper U-shaped open end connected to the mounting opening 513. The connecting plate 51 further has a U-shaped engaging strip 514 disposed on the mounting portion 512 around the mounting opening 513. The engaging strip 514 has two spaced-apart bearing segments 515, and two pairs of snap segments 516. The snap segments 516 of each pair are disposed on one of the bearing segments 515 and are positioned to the mounting portion 512 as shown in FIG. 22. The shaft support body 56 of each movement-transmitting connector 5 has the lubricant supply portion 53, a C-shaped hook portion 59 extending downwardly from the lubricant supply portion 53, and two opposite slide slots 532 formed on two opposite sides of the lubricant supply portion 53 to engage slidably and respectively the bearing segments 515 in an upward and downward movable fashion. With the arrangement of the bearing segments 515 and the slide slots 532, the shaft support body 56 is movable upward and downward relative to the connecting plate 51.

The hook portion 59 extends downwardly from one side of the lubricant supply portion 53 and bends thereafter towards another side of the lubricant supply portion 53 so that the hook portion 59 and the lubricant supply portion 53 cooperatively define a hooking space 50. The hook portion 59 supports a bottom side of the journal section 611 and embraces the same for moving the pinion shafts 61 along therewith. The hook portion 59 has a through hole 521 communicating with the hooking space 50. A top side of the journal section 611 is in contact with the lubricant body 54. Since the journal section 611 is inserted into the hooking space 50 and the through hole 521 is in spatial communication with the hooking space 50, the journal section 611 is able to contact with the bearing segments 515 of the engaging strip 514. Therefore, the shaft support body 56 moves upward and downward to supply the lubricating oil to the journal section 611.

During rotation of the pinion shaft 61, the bearing segments 515 of the connecting plate 51 abut against two opposite sides of the rotating journal section 611. That is to say, the U-shaped open end of the mounting hole 513 and the bearing segments 515 cooperate to act as a bearing. The arrangement as such is different from that disclosed in Austrian Patent No. 006674U2 which uses a movable bearing seat. In addition, the bearing segments 515 have a relatively small area in contact with the pinion shaft 61, thereby reducing a rotational friction force among the pinion shaft 61 and the bearing segments 515. The tubular part 614 surrounds the spindle 62, and the spindle-connecting section 612 is inserted into the engaging hole 621. Therefore, the tubular part 614, the spindle 62, and the spindle-connecting section 612 are covered one over the other and are together received by the bearing segments 515. Therefore, the spindle 62 is prevented from rotating overly and swerving and from affecting adversely the stability of the pinion gear 63 moving on the rack member 41. Austrian Patent No. 006674U2 discloses that a movable bearing seat has a tubular bearing to journal a shaft of a pinion gear, and that a spindle interconnecting two pinion gears is not needed to be received in the bearing seat. Even if the spindle as disclosed in the Austrian patent vibrates overly, the pinion gear can rotate stably. However, the aforesaid movable bearing seat involves relatively large frictional areas and forces which influence adversely smoothness of pulling and pushing a drawer.

In this embodiment, the limit wall 443 of the channel member 44 limits an upward jumping movement of the pinion shaft 61 so that the rotating mechanism 6 can move stably along the rack members 41 and jumping of the pinion gear 63 can be avoided. Because the shaft support body 56 is movable upward and downward relative to the connecting plate 51, even when the guiding units 4 are not properly installed in a horizontal manner, the pinion gears 63, which are meshed with the corresponding rack members 41, can still move along the corresponding guiding units 4 and bring the shaft support body 56 to move upward and downward relative to the connecting plate 51. Preferably, in this embodiment, an auxiliary lubricant body 446 is disposed on the limit wall 443. When the pinion gear 63 rotates on the movement damper 42, the connection portion 616 is able to contact the auxiliary lubricant body 446. Assembly of components is therefore convenient. While the shaft support body 56 is movable relative to the connecting plate 51 in this embodiment, in actual implementation, the shaft support body 56 may be dispensed with. Therefore, whether the support body 56 is installed or not is not a limitation of the present invention.

Figure 23:
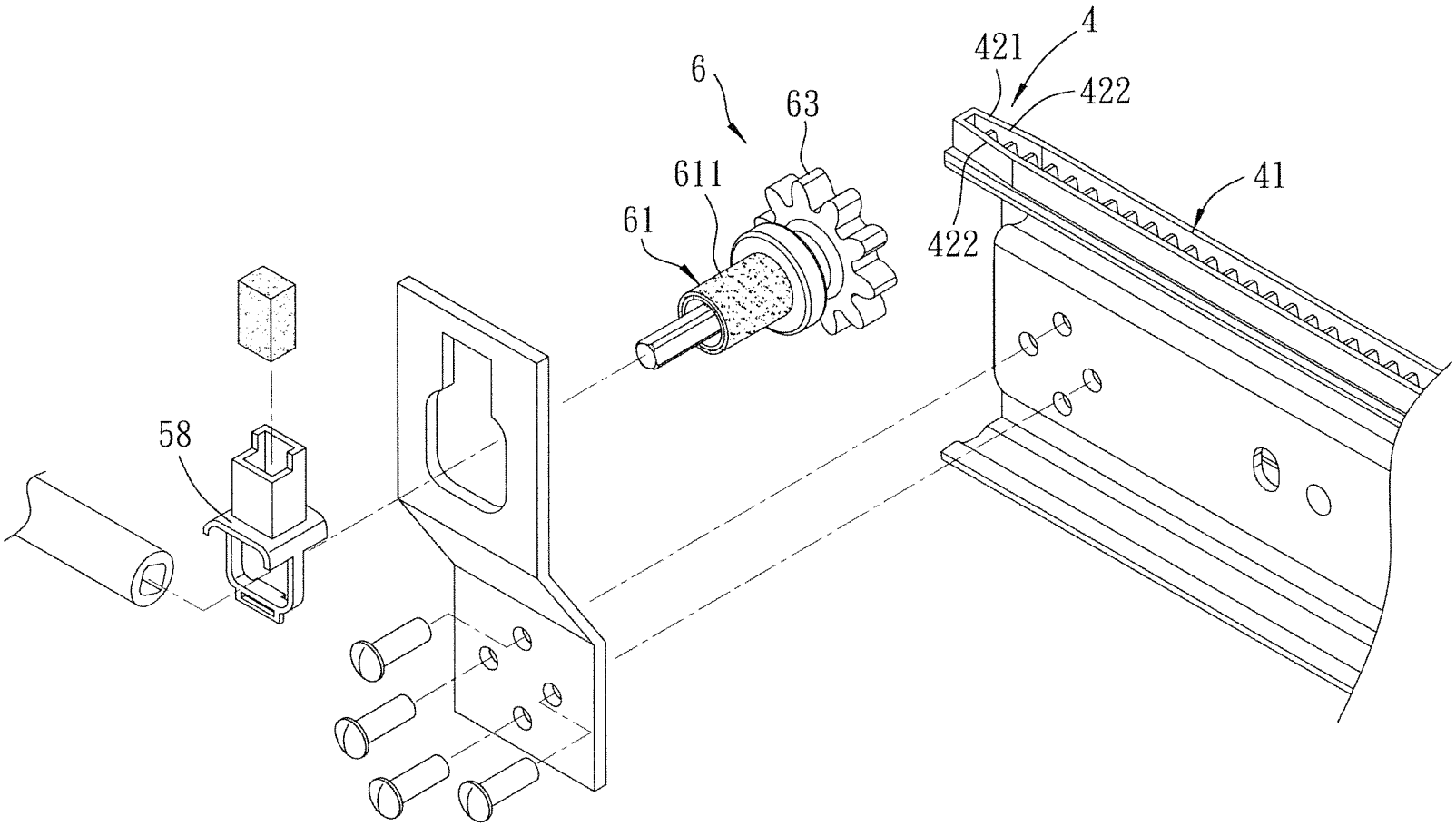
FIG. 23 is an exploded fragmentary perspective view illustrating a ninth preferred embodiment of a synchronizing device according to the present invention.
Figure 24:
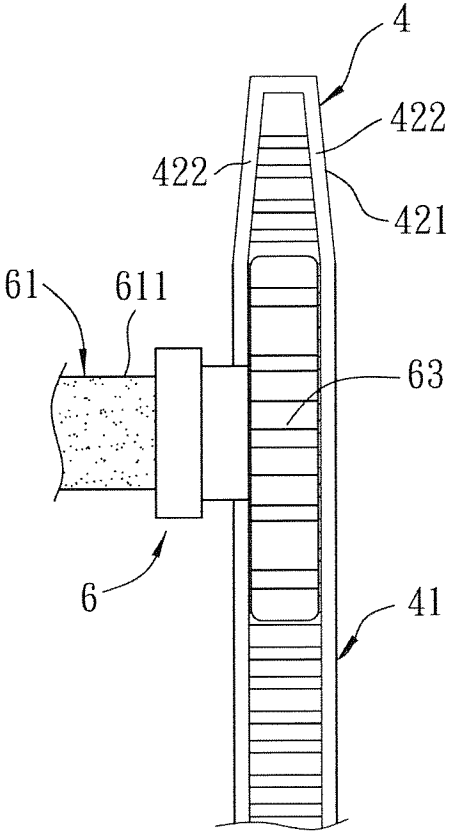
FIG. 24 is a fragmentary top view illustrating the ninth preferred embodiment.

FIGS. 23 and 24 show a ninth preferred embodiment of a synchronizing device according to this invention, which has a structure generally similar to that of the third preferred embodiment. However, in this embodiment, the supporting walls 422 of the movement damper 42 have a width therebetween, which is gradually narrowed from the retaining walls 411 in a direction away from the retaining walls 411. In other words, the supporting walls 422 gradually extend toward each other. When the pinion gear 63 moves on the toothed portion 421, the journal section 611 of the pinion shaft 61 is elevated gradually to abut more and more tightly against the stop plate 58, thereby reducing the rotating speed of the rotating mechanism 6.

Figure 25:
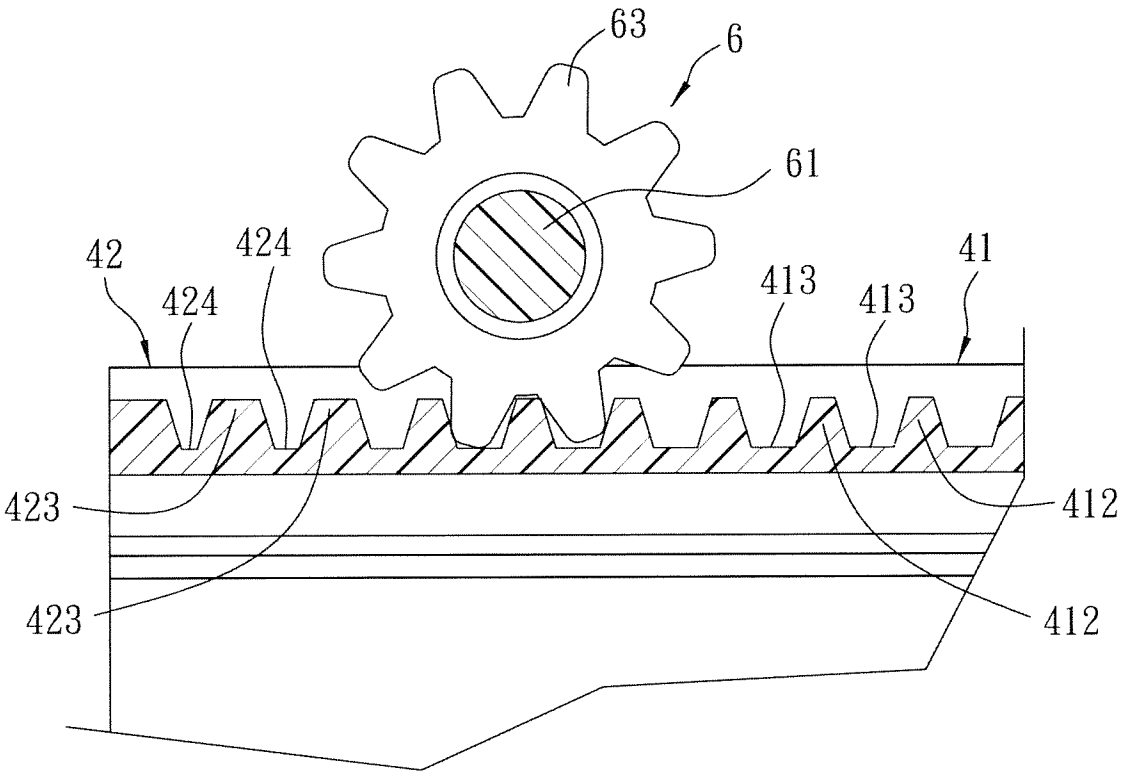
FIG. 25 is a fragmentary sectional view illustrating a tenth preferred embodiment of a synchronizing device according to the present invention.
Figure 26:
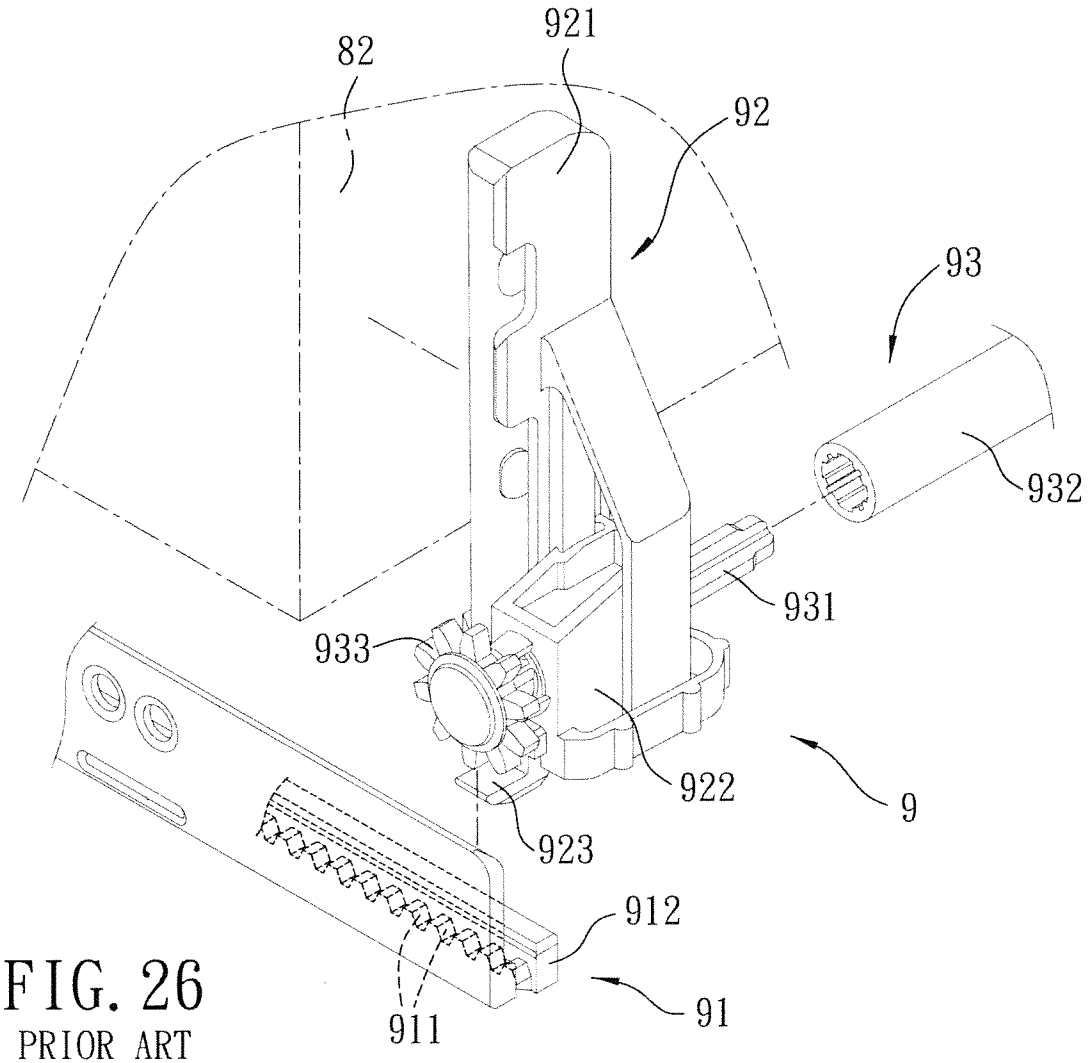
FIG. 26 PRIOR ART
FIG. 26 is an exploded view of the prior art.
Figure 27:
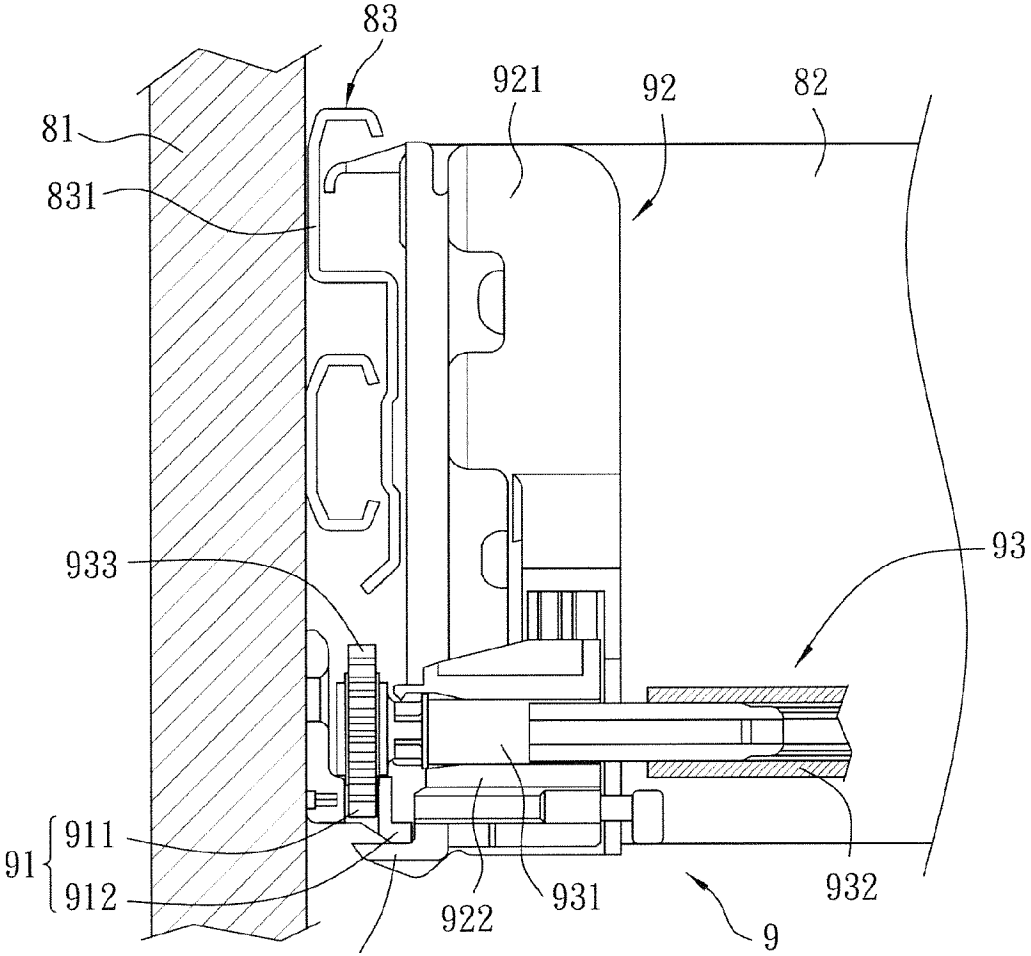
FIG. 27 PRIOR ART
FIG. 27 is a fragmentary sectional view of the prior art.

FIG. 25 shows a tenth preferred embodiment of a synchronizing device according to this invention, which has a structure generally similar to that of the second preferred embodiment. However, in this embodiment, a width of the press grooves 424 of the movement damper 42 is smaller than that of the rack grooves 413 of the rack member 41. The width of the press teeth 423 of the movement damper 42 is larger than that of the rack teeth 412 of the rack member 41. In other words, the press grooves 424 are gradually narrowed from the rack member 41 in a direction away from the rack member 41. The press teeth 423 are gradually widened from the rack member 41 in the direction away from the rack member 41. As such, when the pinion gear 63 rotates on the movement damper 42, the pinion gear 63, which is meshed with the press grooves 424, is gradually elevated, in such a manner that the pinion shaft 61 is elevated gradually until the pinion shaft 61 abuts tightly against the stop plate 58 (see FIG. 5), thereby reducing the rotating speed of the rotating mechanism 6.

To sum up, with the provision of the movement damper 42 in the synchronizing device of the present invention, the rotating mechanism 6 is ensured to be consistently assembled to the guiding unit 4 in the left-right direction such that the two opposite sides of the drawer 2 are synchronously moved to prevent wobbling and jamming of the drawer 2 otherwise caused by an uneven push-pull force. As a result, the drawer 2 can have relatively smooth movement. When the pinion gear 63 of the rotating mechanism 6 moves on the toothed portion 421 of the movement damper 42 of the guiding unit 4, the pinion shaft 61 is gradually elevated by the movement damper 42 to abut tightly against the stop plate 58, thereby slowing down the speed of the rotating mechanism 6. By virtue of the composite structure of the pinion shaft 61 having the outer cover 615 that surrounds the tubular part 614 and that is softer than the tubular part 614 in material quality, continuous impact noise generated during rotation of the non-circular pinion shaft 61 and the movement damper 42 being impeded and abutted can be eliminated. Besides, with the use of the lubricant body 54, lubrication effect is maintained when the pinion shaft 61 is elevated and pressurized, and thus, wear and abrasion can be avoided. At the same time, the abrupt movement of the soft outer cover 615 for eliminating the noise, which is generated by an increase in the friction coefficient due to the soft material of the outer cover 615, can be eliminated by lubrication of the long-acting lubricant body 54. Accordingly, during fast movement of the drawer 2 with loads, smoothness in movement of the drawer 2 can still be kept even if under an immediately decelerated condition, and the entirety of effects of the overall three technical features of this disclosure in correspondence with each other can be maintained. For achieving the purpose of gradually decelerating the rotation of the rotating mechanism 6 nearby one of the front and rear ends of the guiding unit 4, this disclosure has the pressed and abutted pinion shaft 61 to serve as the main principle, which involves the three technical features: (A) the movement damper 42, (B) the journal section 611 of the pinion shaft 61, which has the tubular part 614 and the outer cover 615 that surrounds the tubular part 614 and that is softer than the tubular part 614, and (C) the lubricant body 54. The feature (A) is in correspondence with the feature (B) and must be used in combination with the feature (B). Their technical interrelationship resides in that when the feature (A) has the pinion shaft 61 abutted and pressed, noise will be generated from rotation of the non-circular pinion shaft 61 and the soft and resilient feature (B) has to be used for eliminating the noise. The feature (B) is in correspondence with the feature (C) and must be used in combination with the feature (C). Their technical interrelationship resides in that since the soft material of the feature (B) has a higher friction coefficient, the abrupt movement of the pinion shaft 61 tends to occur due to the pressed and abutted rotation thereof. Hence, the lubrication oil has to be stored in the feature (C) in an unair-dried manner while being capable of continuously lubricating the outer cover 615 of the pinion shaft 61 so as to eliminate the abrupt movement phenomenon. The feature (A) is in correspondence with the feature (C) and must be used in combination with the feature (C). Their technical interrelationship resides in that since the friction abrasion of the pinion shaft 61 is sure to occur due to friction resulted from rotation and abutment when the rotation of the pinion shaft 61 is pressed and abutted by the feature (A), the lubricant oil stored in the feature (C) in an unair-dried manner is required for the feature (C) to abut the pinion shaft 61 so as to maintain constant lubrication of the pinion shaft 61 and so as to eliminate the friction abrasion of the pinion shaft 61. Therefore, the aforesaid three features and the effects thereof are related to each other and constitute unity of invention.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A guiding unit of a synchronizing device to guide a rotating mechanism to rotate thereon, the rotating mechanism having a pinion shaft disposed through a journal hole defined in part by a stop plate, the guiding unit comprising a longitudinal rack member formed with a plurality of rack teeth, and at least one movement damper disposed at one end of said rack member for applying pressure to the pinion shaft of the rotating mechanism, wherein said pressure gradually moves the pinion shaft toward and against the stop plate.

2. The guiding unit as claimed in claim 1, wherein said rack teeth have substantially equal height, said rack member further having a plurality of rack grooves formed between said rack teeth, said movement damper having a toothed portion integrally connected to and aligned longitudinally with said rack member, said toothed portion having at least one press tooth higher than said rack teeth.

3. The guiding unit as claimed in claim 1, wherein said rack teeth have substantially equal height, said rack member further having a plurality of rack grooves formed among said rack teeth, said movement damper having a toothed portion integrally connected to and aligned longitudinally with said rack member, said toothed portion having a plurality of press teeth, and press grooves among said press teeth, said press grooves having a depth that is smaller than that of said rack grooves.

4. The guiding unit as claimed in claim 1, wherein said rack member further has a pair of longitudinal and parallel retaining walls, said rack teeth being longitudinally disposed between said retaining walls, said movement damper having a toothed portion integrally connected to and aligned longitudinally with said rack member, said toothed portion having a pair of supporting walls respectively and integrally connected to said retaining walls, each of said supporting walls having a height greater than that of each of said retaining walls.

5. The guiding unit as claimed in claim 1, wherein said rack teeth have substantially equal height, said rack member further having a longitudinal sliding groove that intersects said rack teeth and that is indented downwardly from tip ends of said rack teeth, said movement damper having a toothed portion integrally connected to and aligned longitudinally with said rack member, said toothed portion having a plurality of press teeth, and an inclined groove that intersects said press teeth, that is indented downwardly from tip ends of said press teeth and that is connected longitudinally and continuously to said sliding groove, said inclined groove having a depth that is smaller than that of said sliding groove and that decreases gradually from said sliding groove in a direction away from said sliding groove.

6. The guiding unit as claimed in claim 1, wherein said rack teeth have substantially equal height, said rack member further having a longitudinal base wall formed with said rack teeth, a sliding wall that is connected transversely to said base wall and that extends substantially vertically at one side of said rack teeth, and a longitudinal sliding hole formed in said sliding wall, said movement damper having a toothed portion integrally connected to and aligned longitudinally with said rack member, said toothed portion having a plurality of press teeth connected integrally to and aligned longitudinally with said rack teeth, a guiding wall that is connected longitudinally to and that extends continuously from said sliding wall, and an inclined hole connected longitudinally and continuously to said sliding hole, said inclined hole having a width smaller than that of said sliding hole, a lower edge that bounds said inclined hole being gradually increased in height from said sliding hole in a direction away from said sliding hole.

7. The guiding unit as claimed in claim 1, further comprising a channel member to receive said rack member and said movement damper, said channel member having a longitudinal top wall extending above said rack member and said movement damper, a bottom wall extending below said rack member and said movement damper, a connecting wall extending downwardly from one end of said top wall and at one side of said rack member and said movement damper to connect to said bottom wall, a channel opening formed at another side of said rack member and said movement damper oppositely of said connecting wall, and a limit wall extending downwardly from another end of said top wall to said channel opening.

8. The guiding unit as claimed in claim 1, wherein said rack teeth have substantially equal height, said rack member further having a pair of retaining walls, said rack teeth being disposed between said retaining walls, said movement damper having a pair of supporting walls respectively and integrally connected to said retaining walls, and a plurality of press teeth connected integrally to and aligned longitudinally with said rack teeth and disposed between said supporting walls, said supporting walls having a width therebetween, which is gradually narrowed from said retaining walls in a direction away from said retaining walls.

9. The guiding unit as claimed in claim 1, the pinion shaft having a journal section, the journal section having a tubular part and an outer cover, the outer cover surrounding the tubular part and made of a flexible material softer than the tubular part.

10. The guiding unit as claimed in claim 9, the rotating mechanism further including at least one movement-transmitting connector, the movement-transmitting connector including a lubricant body positioned to lubricate the journal section.

11. The guiding unit as claimed in claim 10, the movement-transmitting connector including at least one shaft support body for journaling the pinion shaft, the lubricant body disposed in the shaft support body for abutting against the pinion shaft.

12. The guiding unit as claimed in claim 11, the shaft support body having a lubricant supply portion disposed at one side of the pinion shaft and movable upward and downward, the lubricant body being received in the lubricant supply portion.

13. The guiding unit as claimed in claim 11, the movement transmitting connector further including a connecting plate that has a mounting opening, the shaft support body being mounted in the mounting opening.

14. The guiding unit as claimed in claim 9, the pinion shaft further including a spindle-connecting section extending coaxially inside the tubular part, the tubular part and the spindle-connecting section cooperatively defining an annular insert space.

* * * * *